US008900688B2

(12) United States Patent
Sakai et al.

(10) Patent No.: US 8,900,688 B2
(45) Date of Patent: Dec. 2, 2014

(54) GRAIN ORIENTED ELECTRICAL STEEL SHEET AND METHOD OF PRODUCING GRAIN ORIENTED ELECTRICAL STEEL SHEET

(75) Inventors: Tatsuhiko Sakai, Tokyo (JP); Yoshio Nakamura, Tokyo (JP); Kazuyuki Tashiro, Tokyo (JP); Shohji Nagano, Tokyo (JP); Shuichi Yamazaki, Tokyo (JP); Koji Hirano, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 14/119,774

(22) PCT Filed: May 28, 2012

(86) PCT No.: PCT/JP2012/063684

§ 371 (c)(1), (2), (4) Date: Nov. 22, 2013

(87) PCT Pub. No.: WO2012/165393

PCT Pub. Date: Dec. 6, 2012

(65) Prior Publication Data

US 2014/0106130 A1 Apr. 17, 2014

(30) Foreign Application Priority Data

May 27, 2011 (JP) ..... 2011-119326

(51) Int. Cl.
*H01F 1/04* (2006.01)
*C21D 8/12* (2006.01)

(Continued)

(52) U.S. Cl.
CPC ..... *C21D 8/1277* (2013.01); *C21D 8/1283* (2013.01); *C21D 8/1288* (2013.01);

(Continued)

(58) Field of Classification Search
USPC ..... 428/157, 192, 194; 148/111, 113, 307, 148/565
See application file for complete search history.

(56) References Cited

U.S. PATENT DOCUMENTS 4,363,677 A * 12/1982 Ichiyama et al. ..... 148/111
5,028,279 A * 7/1991 Wada et al. ..... 148/111

(Continued)

FOREIGN PATENT DOCUMENTS

JP 64-42530 A 2/1989
JP 2-97622 A 4/1990

(Continued)

OTHER PUBLICATIONS

PCT/ISA/210—International Search Report mailed on Aug. 21, 2012, issued in PCT/JP2012/063684.

(Continued)

*Primary Examiner* — Maria Veronica Ewald
*Assistant Examiner* — Laura Auer
(74) *Attorney, Agent, or Firm* — Birch, Stewart, Kolasch & Birch, LLP

(57) ABSTRACT

To provide a grain oriented electrical steel sheet that can securely suppress propagation of lateral strain, and can make a product even from a portion where the lateral strain occurs. A grain oriented electrical steel sheet of the present invention has a linearly altered portion 14 generated in a glass coating film 12 at one of side edges of a steel sheet 11, in a continuous line or in a discontinuous broken line in a direction parallel with a rolling direction of the steel sheet, and having a composition different from a composition in other portions of the glass coating film. An average value of a deviation angle of a direction of an axis of easy magnetization of crystal grains relative to the rolling direction is 0° or more and 20° or less in a base metal iron portion of the steel sheet 11 at a position along a width direction of the steel sheet, the position corresponding to the linearly altered portion 14.

8 Claims, 11 Drawing Sheets

(51) Int. Cl.

| | |
|---|---|
| ***C21D 10/00*** | (2006.01) |
| ***C22C 38/02*** | (2006.01) |
| ***C22C 38/04*** | (2006.01) |
| ***H01F 1/18*** | (2006.01) |
| ***B05D 3/06*** | (2006.01) |

(52) U.S. Cl.

CPC ..... *C21D 10/005* (2013.01); *C22C 38/02* (2013.01); *C22C 38/04* (2013.01); *H01F 1/18* (2013.01); *B05D 3/06* (2013.01); *C21D 2201/05* (2013.01)

USPC ..... 428/157; 428/192; 428/194; 148/110; 148/565; 427/554

(56) References Cited

U.S. PATENT DOCUMENTS

| | | | | |
|---|---|---|---|---|
| 2003/0183304 | A1* | 10/2003 | Kurosaki et al. | 148/111 |
| 2012/0028069 | A1 | 2/2012 | Sakai et al. | |
| 2013/0139932 | A1 | 6/2013 | Sakai et al. | |

FOREIGN PATENT DOCUMENTS

| | | | |
|---|---|---|---|
| JP | 3-177518 | A | 8/1991 |
| JP | 63-100131 | A | 5/1998 |
| JP | 2000-38616 | A | 2/2000 |
| JP | 2001-323322 | A | 11/2001 |
| WO | WO 2010/103761 | A1 | 9/2010 |
| WO | WO 2012/033197 | A1 | 3/2012 |

OTHER PUBLICATIONS

PCT/ISA/237—mailed on Aug. 21, 2012, issued in PCT/JP2012/063684.

* cited by examiner

EXAMPLE | COMPARATIVE EXAMPLE 1 | COMPARATIVE EXAMPLE 2

GRAIN ORIENTED ELECTRICAL STEEL SHEET AND METHOD OF PRODUCING GRAIN ORIENTED ELECTRICAL STEEL SHEET

TECHNICAL FIELD

The present invention relates to a grain oriented electrical steel sheet having a glass coating film formed on a surface thereof, and to a method of producing the grain oriented electrical steel sheet.

BACKGROUND ART

The above mentioned grain oriented electrical steel sheet is produced by using, for example, a silicon steel slab as a starting material in the following procedure: a hot rolling step, an annealing step, a cold rolling step, a decarburization annealing step, a final annealing step, a flattening annealing step, and an insulating film coating step.

In the annealing prior to the final annealing step, silica ($SiO_2$)-based $SiO_2$ coating films are formed on surfaces of the steel sheet. In the final annealing step, the steel sheet is wound up in a coil shape, and in this state, the steel sheet is placed in a batch-type annealing furnace so as to be subjected to heat treatment. In order to prevent seizing of the steel sheet during the final annealing step, surfaces of the steel sheet is coated with a magnesia (MgO)-based annealing separator prior to the final annealing step. In the final annealing step, the $SiO_2$ coating film and the magnesia-based annealing separator react with each other, thereby forming the aforementioned glass coating film.

Here, the final annealing step will be described in detail. As shown in FIG. 1, in the final annealing step, a coil 5 formed by winding up the steel sheet is placed on a coil receiver 8 under an annealing furnace cover 9 with a coil axis 5*a* of the coil 5 positioned in the vertical direction.

As shown in FIG. 2, when the coil 5 positioned in this manner is annealed at high temperatures, a lower edge portion 5*z* of the coil 5 in contact with the coil stand 8 is plastically deformed because of the weight of the coil 5, a difference between the thermal expansion coefficient of the coil receiver 8 and the thermal expansion coefficient of the coil 5, and the like. Such a deformation cannot be completely removed even in the subsequent flattening annealing step, and this deformation is usually referred to as a lateral strain deformation. If the lateral strain deformation does not satisfy a requirement specified by a customer, a lateral strained portion 5*e* in which the lateral strain deformation occurs is trimmed. Hence, there is a problem of increase in the trimming width of the lateral strained portion 5*e* as the lateral strained portion 5*e* increases, which deteriorates the yield. When the steel sheet 1*a* unwound from the coil 5 is placed on a flat surface plate, the lateral strain is observed as a height h of a wave of the edge portion of the steel sheet 1*a* lifted up from the flat surface plate, as shown in FIG. 3. Normally, the lateral strained portion 5*e* is a deformation region in the edge portion of the steel sheet that satisfies a condition that the wave height h is more than 2 mm, or a condition that a steepness s represented by the following formula (1) is more than 1.5% (more than 0.015):

$$s=h/l \quad (1),$$

where l denotes a width of the lateral strained portion.

A mechanism of occurrence of the lateral strain at the time of the final annealing can be explained by grain boundary sliding at high temperatures. Specifically, deformation due to the grain boundary sliding becomes significant at high temperatures of 900° C. or more; therefore, the lateral strain is likely to occur at the grain boundary portions. In the lower edge portion of the coil in contact with the coil receiver, the growing of secondary recrystallization occurs later than that in a central portion of the coil. Hence, the grain size becomes smaller at the lower edge portion of the coil, which is likely to generate a refined grain portion.

It is considered that there are a large number of grain boundaries in such a refined grain portion, so that the grain boundary sliding is likely to occur in this portion, which causes lateral strain. Thus, there have been proposed various conventional methods of controlling the growth of crystal grains at the lower edge portion of the coil so as to reduce mechanical deformation (lateral strain) at the lower edge portion of the coil.

Patent Document 1 discloses a method of applying a grain refiner to a strip portion having a constant width from the lower edge of the coil in contact with the coil receiver before the final annealing so as to refine grains in the strip portion during the final annealing. Patent Document 2 discloses a method of applying mechanical deformation strain using a roller with protrusions thereon or the like to a strip portion having a constant width from the lower edge of the coil in contact with a coil receiver prior to the final annealing so as to refine grains in this strip portion during the final annealing.

In the methods of Patent Documents 1 and 2, in order to reduce lateral strain, crystal grains at the lower edge portion of the coil are intentionally refined in the above manners, thereby changing the mechanical strength at the lower edge portion of the coil.

In the method disclosed in Patent Document 1, however, the grain refiner is liquid, which makes it difficult to accurately control a region where the grain refiner is applied. The grain refiner may be diffused from the edge portion toward the central portion of the steel sheet in some cases. Consequently, it becomes difficult to control the width of the grain refinement region to be constant, and thus the width of the lateral strained portion becomes greatly varied in the longitudinal direction of the coil. As the width of the lateral strained portion having the greatest deformation determines a trimming width, if the lateral strained portion has a great width even at a single position, the trimming width increases, and the yield is deteriorated.

In the method disclosed in Patent Document 2, grain refinement of crystals at the lower edge portion of the coil is initiated by the strain generated through machining using a roller or the like. The roller, however, wears out due to continuous machining for a long time, which deteriorates the strain generated through mechanical deformation strain (reduction ratio) applied to the steel sheet with time, resulting in deterioration of the grain refining effect. In particular, the grain oriented electrical steel sheet is a hard material containing a large amount of Si, and wear of the roller becomes significant, and thus it is required to frequently replace the roller. Moreover, since machining induces the strain in a wide range, there are limitations on the range of reducing the lateral strain.

Patent Documents 3, 4, 5, and 6 disclose methods in which, in order to reduce lateral strain, secondary recrystallization is encouraged in the strip portion having a constant width extending from the lower edge of the coil so as to increase the grain size at an early stage of the final annealing, thereby enhancing high temperature strength.

Patent Documents 3 and 4 disclose, as a solution to increase the grain size, a method of heating the strip portion at the edge portion of the steel sheet through plasma heating or induction heating prior to the final annealing. Patent Documents 3, 5, and 6 disclose a method of employing mechanical strain using shot blast, a roller, or a gear roller, or the like.

The plasma heating and the induction heating are suitable for heating a band region because the plasma heating and the induction heating are heating processes having a relatively wide heating range. However, the plasma heating and the induction heating have a problem of difficulties in controlling a heating position and a heating temperature. Another problem is that a wider range than a prescribed range is heated due to heat conduction. Hence there arises a problem of failure to uniformly control a width of a range where the grain size is increased through secondary recrystallization, and thus the lateral strain reduction effect is likely to be non-uniform.

As mentioned above, the mechanical method using a roller or the like has the problem of deterioration of the strain applying effect (amount of strain) with time due to wear of the roller. In particular, speed of the secondary recrystallization sensitively varies depending on the strain amount; therefore, even a slight strain amount due to the wear of the roller disadvantageously hinders attainment of a desired grain size, so that it becomes impossible to attain stable lateral strain reduction effect. In addition, since machining induces strain in a wide range, there are limitations on the range of reducing the lateral strain.

As described above, the methods disclosed in Patent Documents 1 to 6 have a problem of difficulty in accurately controlling the grain size (range and size), and thus the lateral strain reduction effect cannot be sufficiently attained.

Patent Document 7 proposes a technique of generating an easy deformable portion (groove or grain boundary sliding portion), or high-temperature deformable portion extending parallel with the rolling direction in one of the side edge regions of the steel sheet by radiating a laser beam, using water jet, or the like. In this case, the easy deformable portion (groove or grain boundary sliding deformable portion) generated in the one of the side edge regions of the steel sheet prevents propagation of the lateral strain, thereby enabling reduction of the width of the lateral strained portion.

PRIOR ART DOCUMENTS

Patent Documents

[Patent Document 1] JP S63-100131A
[Patent Document 2] JP S64-042530A
[Patent Document 3] JP H02-097622A
[Patent Document 4] JP H03-177518A
[Patent Document 5] JP 2000-038616A
[Patent Document 6] JP 2001-323322A
[Patent Document 7] WO 2010/103761A

SUMMARY OF THE INVENTION

Problems to be Solved by the Invention

In the method of generating the grain boundary sliding deformable portion as disclosed in Patent Document 7, the easy deformable portion is directly generated in a base metal iron portion of the steel sheet. This easy deformable portion is a linear region including grain boundaries generated in the base metal iron portion of the steel sheet during the final annealing, or is a sliding strip region including crystal grains generated in the base metal iron portion of the steel sheet. Prior to the final annealing, a laser beam is radiated onto the surface of the steel sheet so as to generate the easy deformable portion in a heat affected portion of the base metal iron portion. At this time, the base metal iron portion of the region irradiated with the laser beam melts by heat of the laser beam, and is then resolidified, so that abnormal grains whose axis of easy magnetization deviates from the rolling direction of the steel sheet are generated at a high percentage in the easy deformable portion generated during the final annealing. This deteriorates the magnetic property in the base metal iron portion of the region where the easy deformable portion is generated.

As aforementioned, if the width of the lateral strained portion is reduced in a small range, the grain oriented electrical steel sheet having the lateral strained portion may satisfy quality required by a customer, and it may be unnecessary to carry out trimming of the lateral strained portion. In the invention described in Patent Document 7, however, even if the lateral strained portion is allowable, the abnormal crystal grains existing in the base metal iron portion where the easy deformable portion is generated deteriorate the magnetic property, which disadvantageously deteriorates the quality of the grain oriented electrical steel sheet.

In order to generate the easy deformable portion in the entire thickness direction from the surface of the steel sheet, or down to a deep position inside the steel sheet, it is required to apply great energy to the steel sheet. Consequently, preparation is time-consuming prior to the final annealing, or a large-scale and high-power laser apparatus is required, which disadvantageously hinders efficient production of the grain oriented electrical steel sheet.

An object of the present invention, which has been made in view of the above-described circumstances, is to provide a grain oriented electrical steel sheet in which propagation of lateral strain is securely suppressed by laser beam radiation onto a side edge of the steel sheet, and deterioration of the magnetic property of the steel sheet by being heat affected by the laser beam is reduced.

Means for Solving the Problems

In order to solve the above problems, according to an aspect of the present invention, a grain oriented electrical steel sheet having a glass coating film formed on a surface thereof is provided, the grain oriented electrical steel sheet including a linearly altered portion generated in the glass coating film at one of side edges of the steel sheet, in a continuous line or in a discontinuous broken line in a direction parallel with a rolling direction of the steel sheet, and having a composition different from a composition in other portions of the glass coating film. An average value of a deviation angle of a direction of an axis of easy magnetization of crystal grains relative to the rolling direction is 0° or more and 20° or less in a base metal iron portion of the steel sheet at a position along a width direction of the steel sheet, the position corresponding to the linearly altered portion.

A characteristic X-ray intensity Ia of Mg in the linearly altered portion of the glass coating film may be smaller than an average value Ip of the characteristic X-ray intensity of Mg in the other portions of the glass coating film.

The average value Ip of the characteristic X-ray intensity of Mg in the other portions of the glass coating film and the characteristic X-ray intensity Ia of Mg in the linearly altered portion may be obtained through an EPMA analysis, and the linearly altered portion may be identified in the glass coating film as an Mg reduced portion whose Mg reduction ratio Ir that is a ratio of the Ia relative to the Ip is 0.3 or more and less than 1.0.

In addition, the linearly altered portion may be identified as the Mg reduced portion whose Mg reduction ratio Ir is 0.3 or more and 0.95 or less.

A laser beam may be radiated in a direction parallel with the rolling direction onto a region at the one of the side edge regions of the steel sheet having an $SiO_2$ coating film formed on a surface thereof, so as to generate a laser processed portion in a continuous line or in a discontinuous broken line in a depth region from an outer layer of the $SiO_2$ coating film toward a boundary between the $SiO_2$ coating film and the steel sheet, the laser processed portion in the $SiO_2$ coating film may be altered, and the linearly altered portion may be generated in the glass coating film.

A distance WL from the one of the side edges of the steel sheet to a center with respect to the width direction of the linearly altered portion may be 5 mm or more and 35 mm or less, and a width d of the linearly altered portion may be 0.3 mm or more and 5.0 mm or less.

The linearly altered portion may be generated in a region of 20% or more and 100% or less of a total length in the rolling direction of the steel sheet, and the region starts from one end in the rolling direction of the steel sheet corresponding to an outermost periphery of the steel sheet when the steel sheet is wound up in a coil shape in a final annealing step.

According to another aspect of the present invention, a method of producing a grain oriented electrical steel sheet having a glass coating film formed on a surface thereof is provided, the method including a laser processing step of radiating, onto one of side edge regions of a steel sheet having an $SiO_2$ coating film formed on a surface thereof, a laser beam in a direction parallel with a rolling direction of the steel sheet so as to generate a laser processed portion in a continuous line, or in a discontinuous broken line; an annealing separator coating step of coating each surface of the steel sheet with an annealing separator after the laser processing step; and a final annealing step of finally annealing the steel sheet which is coated with the annealing separator so as to form the glass coating film on each surface of the steel sheet. The laser processed portion is generated in a depth region from an outer layer of the $SiO_2$ coating film toward a boundary between the $SiO_2$ coating film and the steel sheet, in the final annealing step, the steel sheet is wound up in a coil shape, the steel sheet in the coil shape is placed and finally annealed with the one of the side edges thereof where the laser processed portion is directed downward, the glass coating film is generated from the $SiO_2$ coating film and the annealing separator, and a linearly altered portion having a composition different from a composition in other portions of the glass coating film is formed in a portion corresponding to the laser processed portion.

In the laser processing step, the laser processed portion may be generated in such a manner that a distance WL from the one of the side edges of the steel sheet to a center with respect to the width direction of the laser processed portion is 5 mm or more and 35 mm or less, and a width d of the laser processed portion is 0.3 mm or more and 5.0 mm or less.

In the laser processing step, the laser processed portion may be generated in a region of 20% or more and 100% or less of a total length in the rolling direction of the steel sheet, and the region starts from one end in the rolling direction of the steel sheet corresponding to an outermost periphery of the steel sheet when the steel sheet is wound up in a coil shape in the final annealing step.

According to the grain oriented electrical steel sheet and the producing method of the same, the linearly altered portion extending in the rolling direction is generated in the glass coating film in one of the side edge portions of the steel sheet, so that the linearly altered portion is locally deformed, thereby suppressing propagation of the lateral strain. Here, it is preferable to set a distance WL from the one of the side edges of the steel sheet to the center with respect to the width direction of the linearly altered portion (laser processed portion) as 5 mm or more and 35 mm or less, and to set a width d of the linearly altered portion (laser processed portion) as 0.3 mm or more and 5.0 mm or less. Through this configuration, it is possible to securely reduce the width of the lateral strained portion.

The linearly altered portion is generated only in the glass coating film, and not generated in the base metal iron portion of the steel sheet. In addition, in a portion of the base metal iron portion of the steel sheet adjacently below the linearly altered portion, an average value of the deviation angle of the direction of the axis of easy magnetization of the crystal grains in the base metal iron portion of the steel sheet relative to the rolling direction is adjusted to be 20° or less. Accordingly, the magnetic property becomes stable not only in the portion of the base metal iron portion that does not correspond to the linearly altered portion, but also in the portion adjacently below the linearly altered portion, which allows the portion in which the linearly altered portion is generated to be available as a product.

In the present invention, the deviation angle is defined by a mean-square value $\theta a$ of an angle $\theta t$ and an angle $\theta n$, wherein the angle $\theta t$ is formed by the direction of the axis of easy magnetization of the crystal grains, which are measured with the crystal orientation measurement method (the Laue method) using X-ray diffraction, turning from the rolling direction in the steel sheet face serving as a reference around a width directional axis of the steel sheet, and the angle $\theta n$ is formed by the direction of the axis of easy magnetization of the crystal grains turning from the rolling direction around an axis vertical to the face of the steel sheet; and crystal grains having $\theta a$ of 20° or more are referred to as "abnormal crystal grains".

It is preferable that the characteristic X-ray intensity Ia of Mg in the linearly altered portion is smaller than the average value Ip of the characteristic X-ray intensity of Mg in the other portions of the glass coating film. It is also preferable that the linearly altered portion is identified as the linear Mg reduced portion whose Mg reduction ratio Ir, which is a ratio of Ia relative to Ip, is 0.3 or more and less than 1.0, in particular, 0.95 or less. The amount of Mg is smaller in this linear Mg reduced portion than that in the other portions of the glass coating film. Mg is a representative element in the glass coating film, so that it is estimated that the thickness of the glass coating film itself is reduced in the linear Mg reduced portion. Hence, the mechanical strength in the linear Mg reduced portion is smaller than that in the other portions of the glass coating film, and the linear Mg reduced portion becomes easily locally deformed; thus it is possible to suppress propagation of the lateral strain.

In the present invention, the thickness of the glass coating film is reduced in the portion corresponding to the linear Mg reduced portion, but there is no problem in electric insulation property as a transformer if an insulating coating film is formed on the glass coating film.

Effects of the Invention

As aforementioned, according to the present invention, the linearly altered portion generated in the portion corresponding to the laser processed portion in the glass coating film can suppress propagation of the lateral strain.

In addition, there is a low percentage of abnormal crystal grains also in the portion of the base metal iron portion of the steel sheet adjacently below the linearly altered portion, and thus it is possible to suppress deterioration of the magnetic property of the steel sheet by being heat affected by the laser beam. Accordingly, it is possible to provide a high-quality grain oriented electrical steel sheet whose crystal orientation is stable through the entire steel sheet.

BRIEF DESCRIPTION OF THE DRAWINGS

FIG. 2 is a schematic diagram showing a growing process of lateral strain in a conventional coil having no solution to reduce lateral strain implemented for.

MODES FOR CARRYING OUT THE INVENTION

Figure 1:
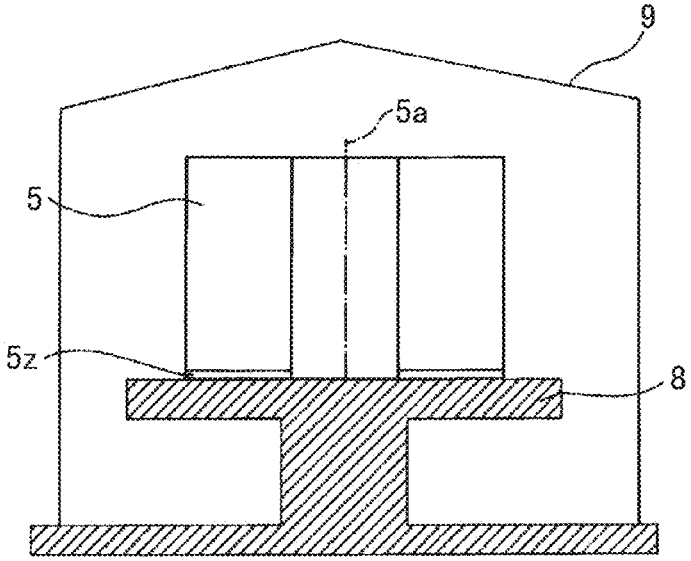
FIG. 1 is a drawing explaining an example of a final annealing unit.
Figure 2:
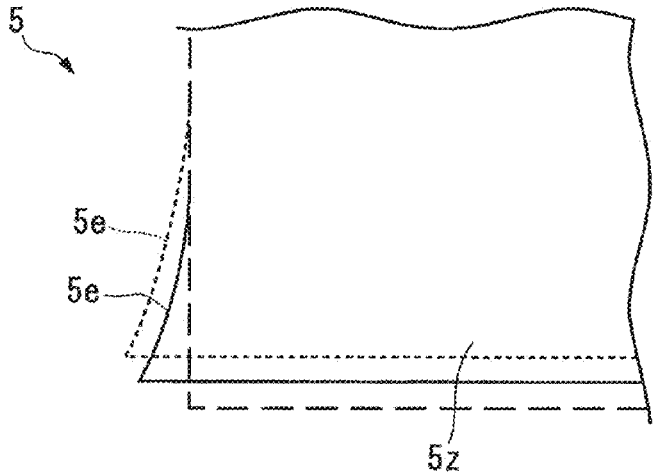
Figure 3:
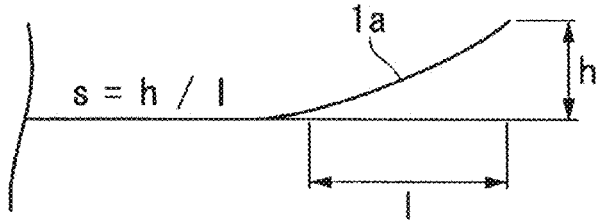
FIG. 3 is an explanatory drawing showing an example of an evaluation method of the lateral strain.

Hereinafter, referring to the appended drawings, a grain oriented electrical steel sheet and a producing method of the grain oriented electrical steel sheet according to preferred embodiments of the present invention will be described in detail. It should be noted that, in this specification and the appended drawings, structural elements that have substantially the same function and structure are denoted with the same reference numerals, and repeated explanation thereof is omitted. The present invention is not limited to the following embodiments.

Figure 4:
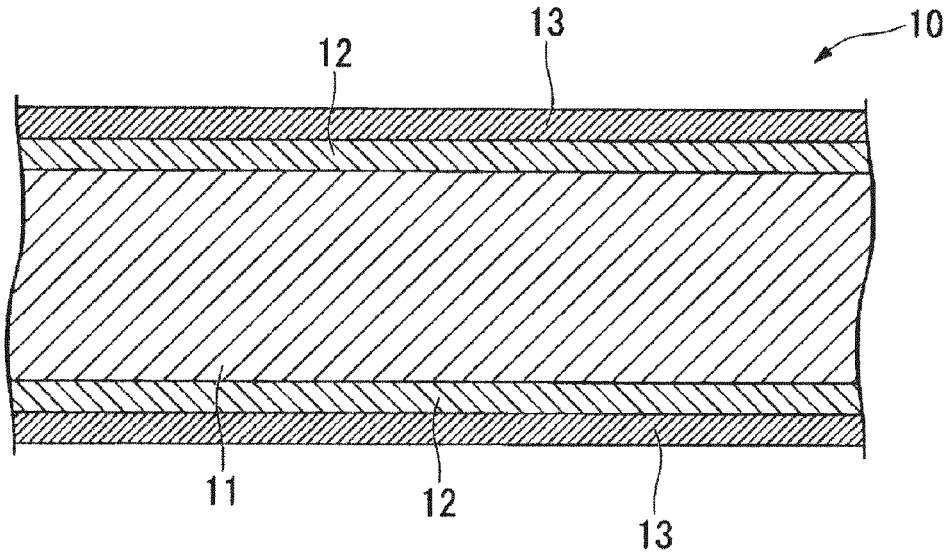
FIG. 4 is a cross sectional view of a grain oriented electrical steel sheet in one embodiment of the present invention.

A grain oriented electrical steel sheet 10 of the present embodiment includes a steel sheet 11, a glass coating film 12 formed on each surface of the steel sheet, and an insulating coating film 13 formed on each glass coating film 12, as shown in FIG. 4.

The steel sheet 11 is made of an iron alloy containing Si, which is used as a common material for a grain oriented electrical steel sheet. The steel sheet 11 according to the present embodiment may include the following composition, for example:

Si: 2.5 mass % or more and 4.0 mass % or less,
C: 0.02 mass % or more and 0.10 mass % or less,
Mn: 0.05 mass % or more and 0.20 mass % or less,
Acid-soluble Al: 0.020 mass % or more and 0.040 mass % or less,
N: 0.002 mass % or more and 0.012 mass % or less,
S: 0.001 mass % or more and 0.010 mass % or less,
P: 0.01 mass % or more and 0.04 mass % or less, and
Balance: Fe and inevitable impurities.

The steel sheet 11 usually has a thickness of 0.15 mm or more and 0.35 mm or less, and the thickness may be out of this range.

The glass coating film 12 is made of complex oxide, such as forsterite ($Mg_2SiO_4$), spinel ($MgAl_2O_4$), or cordierite ($Mg_2Al_4Si_5O_{16}$), for example. The thickness of the glass coating film 12 is 0.5 μm to 3 μm for example, and in particular, is generally around 1 μm, but it is not limited to these examples.

The insulating coating film 13 is made of coating liquid mainly containing colloidal silica and phosphate (such as magnesium phosphate or aluminum phosphate) (see JP S48-39338A, JP S53-28375B), or coating liquid formed by mixing alumina sol and boric acid (see JP H6-65754A, JP H6-65755A). In the present embodiment, the insulating coating film 13 is made of aluminum phosphate, colloidal silica, chromium trioxide, or the like (see JP S53-28375B), for example. The insulating coating film 13 generally has a thickness of approximately 2 μm, but this thickness is not limited to this example.

Figure 5:
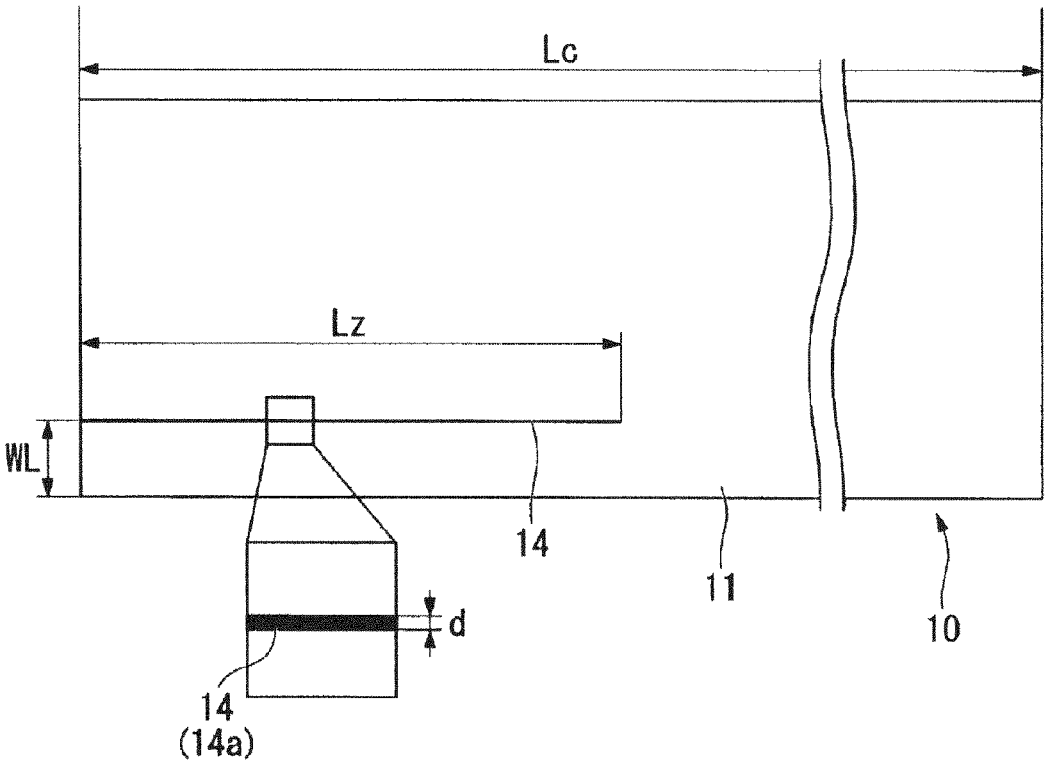
FIG. 5 is an explanatory drawing showing the grain oriented electrical steel sheet in one embodiment of the present invention.

In the grain oriented electrical steel sheet 10 of one embodiment of the present invention, as shown in FIG. 5, a linearly altered portion 14 into which a part of the glass coating film 12 is altered is generated in one of the surfaces or both surfaces of the grain oriented electrical steel sheet 10. The linearly altered portion 14 has a composition or thickness different from that of the other portions of the glass coating film 12. Such a difference in the linearly altered portion 14 of the glass coating film 12 can be identified as a difference in content of elements constituting the glass coating film 12, such as Mg and Fe.

As shown in FIG. 5, the linearly altered portion 14 is generated in a linear form in a direction parallel with the rolling direction (longitudinal direction of the steel sheet 11) inward of one of the side edges of the grain oriented electrical steel sheet 10 by a prescribed distance WL. In the example of FIG. 5, the linearly altered portion 14 is generated in a continuous line in a direction parallel with the rolling direction. The linearly altered portion 14, however, is not limited to such an example, and may be formed in a discontinuous line, for example, in a broken line periodically disconnected. Such a linearly altered portion 14 is generated by converging a laser beam and radiating it onto the surface of the steel sheet 11, as described later.

As aforementioned, in the grain oriented electrical steel sheet 10 according to one embodiment of the present invention, the linearly altered portion 14 is generated in the rolling direction in the glass coating film 12 on the surface at the one of the side edges of the steel sheet 11. This linearly altered portion 14 has a smaller mechanical strength, and is more easily deformed than the other portions of the glass coating film 12. Therefore, in the final annealing step, the linearly altered portion 14 is preferentially deformed locally in the coil 5 formed by winding up the steel sheet 11, thereby suppressing propagation of the lateral strain progressing upward of the coil 5 from a lower edge thereof. Accordingly, in the step subsequent to the final annealing step, it is possible to reduce the trimming width of the grain oriented electrical steel sheet 10 as much as possible.

The linearly altered portion 14 may be partially generated in the longitudinal direction (rolling direction) of the steel sheet 11. In this case, it is preferable that the linearly altered portion 14 is generated in a region of 20% or more and 100% or less of the total longitudinal length of the steel sheet 11, starting from the outermost peripheral portion of the coil 5 formed by winding up the steel sheet 11. Specifically, the longitudinal length Lz of the linearly altered portion 14 extending from an end along the longitudinal direction of the grain oriented electrical steel sheet 10 is preferably 20% or more of the total length Lc of the grain oriented electrical steel sheet 10 ($Lz \geq 0.2 \times Lc$).

The lateral strain is more likely to be generated at the outer peripheral portion of the coil 5 because this outer peripheral portion is heated at high temperatures during the final annealing. Hence, it is preferable to generate the linearly altered portion 14 starting from the outermost peripheral portion of the coil 5 in a region of 20% or more of the total length Lc of the coil 5. Thereby, during the final annealing step, the linearly altered portion 14 generated in the outermost peripheral portion of the coil 5 becomes locally deformed, thereby securely suppressing propagation of the lateral strain in the outer peripheral portion of the coil 5. To the contrary, if the region where the linearly altered portion 14 is generated is less than 20% of the entire length Lc of the coil 5, the linearly altered portion 14 having a sufficient length is not generated in the outer peripheral portion of the coil 5, and thus the lateral strain reduction effect is deteriorated in the outer peripheral portion of the coil 5.

In order to further securely suppress propagation of the lateral strain, the linearly altered portion 14 may be generated over the entire length in the longitudinal direction (rolling direction) of the steel sheet 11.

The linearly altered portion 14 is generated at a position where a distance WL from the one of the side edges of the grain oriented electrical steel sheet 10 to the center with respect to the width direction of the linearly altered portion 14 is 5 mm or more and 35 mm or less ($5\ mm \leq WL \leq 35\ mm$). In addition, the width d of the linearly altered portion 14 is 0.3 mm or more and 5.0 mm or less ($0.3\ mm \leq d \leq 5.0\ mm$).

In this manner, the linearly altered portion 14 is generated at the position that satisfies $5\ mm \leq WL \leq 35\ mm$, and the width d of the linearly altered portion 14 satisfies $0.3\ mm \leq d \leq 5.0\ mm$, thereby generating the linearly altered portion 14 that becomes easily deformed during the final annealing step at a position where reduction of the lateral strain can be attained; thus it is possible to securely reduce the width of the lateral strained portion.

Figure 6A:
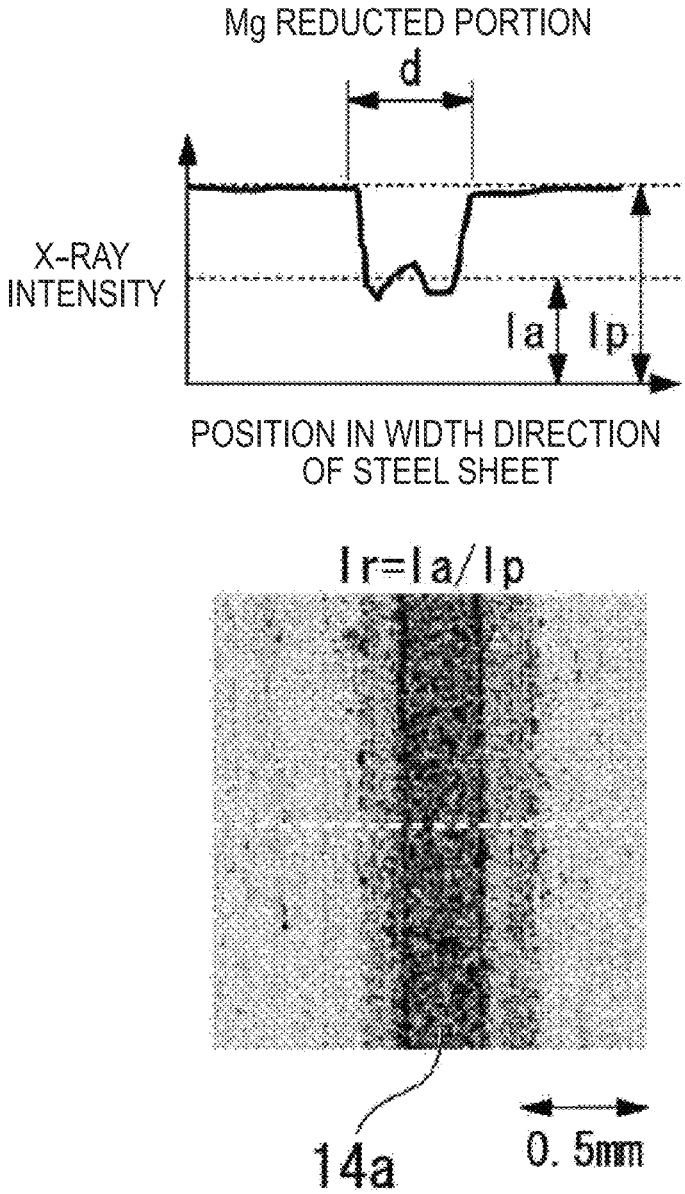
FIG. 6A is an explanatory drawing showing a linearly altered portion in the grain oriented electrical steel sheet shown in FIG. 4.
Figure 6B:
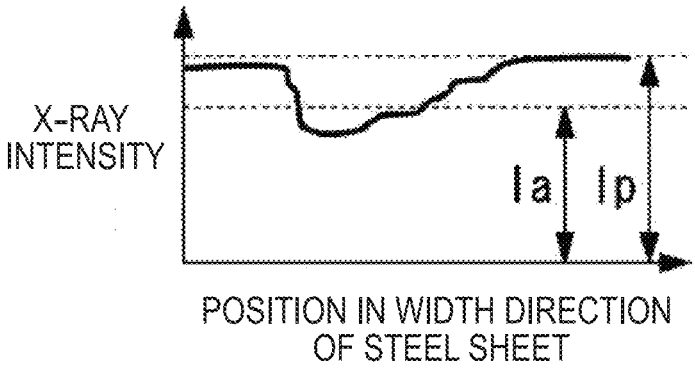
FIG. 6B is an explanatory drawing showing the linearly altered portion in the grain oriented electrical steel sheet shown in FIG. 4.

The linearly altered portion 14 is often difficult to be confirmed through a visual observation, through a microscope observation, or the like on the surface of the grain oriented electrical steel sheet 10. In the linearly altered portion 14, however, the characteristic X-ray intensity of Mg of the glass coating film 12 obtained through an EPMA analysis (Electron Probe Micro Analysis) tends to be smaller than that in the other portions of the glass coating film 12. That is, as shown in FIG. 6A and FIG. 6B, the linearly altered portion 14 can be observed as a linear Mg reduced portion 14*a* that is defined based on a Mg reduction ratio obtained through the EPMA analysis on the glass coating film 12. Specifically, the linear Mg reduced portion 14*a* may be a region where the Mg reduction ratio Ir ($Ir = Ia/Ip$) obtained through the EPMA analysis on the glass coating film 12 is within a range of $0.3 \leq Ir \leq 1.0$.

Here, the Mg reduction ratio Ir is a value obtained by dividing the characteristic X-ray intensity Ia of Mg in a portion of the glass coating film 12 where the linearly altered portion 14 is generated (region corresponding to a laser processed portion 20 described later) by an average value Ip of the characteristic X-ray intensity of Mg in the other portions of the glass coating film 12, out of the region corresponding to the laser processed portion 20 described later, where no linearly altered portion 14 is generated.

Thus, the Mg reduction ratio Ir is a reduction ratio of the characteristic X-ray intensity of Mg in the glass coating film 12, and the linear Mg reduced portion 14*a* is a linear region in which the characteristic X-ray intensity of Mg is smaller than that in the other portions of the glass coating film 12. In the grain oriented electrical steel sheet 10 according to the present embodiment, the linearly altered portion 14 can be identified as the linear Mg reduced portion 14*a* in which the Ir is within the range of $0.3 \leq Ir \leq 1.0$.

In the linearly altered portion 14, the characteristic X-ray intensity of Fe of the glass coating film 12 obtained through the EPMA analysis tends to be greater than that in the other portions of the glass coating film 12. Hence, the linearly altered portion 14 can also be identified by using this characteristic X-ray intensity of Fe. Alternatively, the linearly altered portion 14 can be identified by using a characteristic X-ray spectrum of Al, Si, Mn, O, or the like, which is contained as a glass component in the glass coating film 12.

Figure 6B:
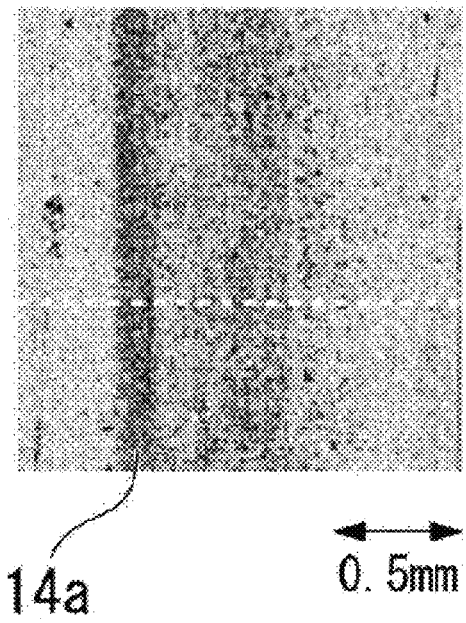

The EPMA analysis in FIG. 6 was carried out using the spatially resolved EPMA under the following conditions: the radiation intensity of electron beam of 15 keV, the magnification of ×50, the visual field area of 2.5 mm×2.5 mm, the spatial resolution of 5 μm, and the X-ray analyzing crystal: TAP.

In the present embodiment, in the base metal iron portion of the steel sheet 11 located at a portion inward of the linearly altered portion 14, an average value of a deviation angle θa between the direction of the axis of easy magnetization of the crystal grains and the rolling direction is 0° or more and 20° or less, preferably 0° or more and 10° or less.

In the present embodiment, the deviation angle θa between the direction of the axis of easy magnetization of the crystal grains and the rolling direction is defined as follows. That is, the deviation angle θa is defined by a mean-square value of an angle θt and an angle θn ($\theta a=(\theta t^2+\theta n^2)^{0.5}$), wherein the angle θt is formed by the direction of the axis of easy magnetization of the crystal grains of interest turning from the rolling direction in the steel sheet face serving as a reference around a width-directional axis of the steel sheet, and the angle θn is formed by the direction of the axis of easy magnetization of the crystal grains of interest turning from the rolling direction around an axis vertical to the face of the steel sheet. The θt and θn are measured with the crystal orientation measurement method (the Laue method) using X-ray diffraction. In the present embodiment, crystal grains of θa≥20° are referred to as "abnormal crystal grains", and this means crystal grains whose axis of easy magnetization greatly deviates from the rolling direction of the steel sheet 11. To the contrary, crystal grains having θa of less than 20° are referred to as "normal crystal grains". If the axis of easy magnetization of the crystal grains greatly deviates from the rolling direction, the direction of magnetization at this portion is likely to be oriented to a direction greatly different from the rolling direction, which hinders lines of magnetic force from passing in the rolling direction. Consequently, the magnetic property in the rolling direction of the steel sheet 11 is deteriorated.

With respect to the crystal orientation of the grain oriented electrical steel sheet, the easy direction of magnetization of a preferable product may sometimes deviate from the rolling direction by several degrees. In the present embodiment, also considering the magnetic property, as a reference for abnormal crystal grains whose axis of easy magnetization greatly deviates from the rolling direction, the lower limit of the above θa is set to be 20°.

Figure 18:
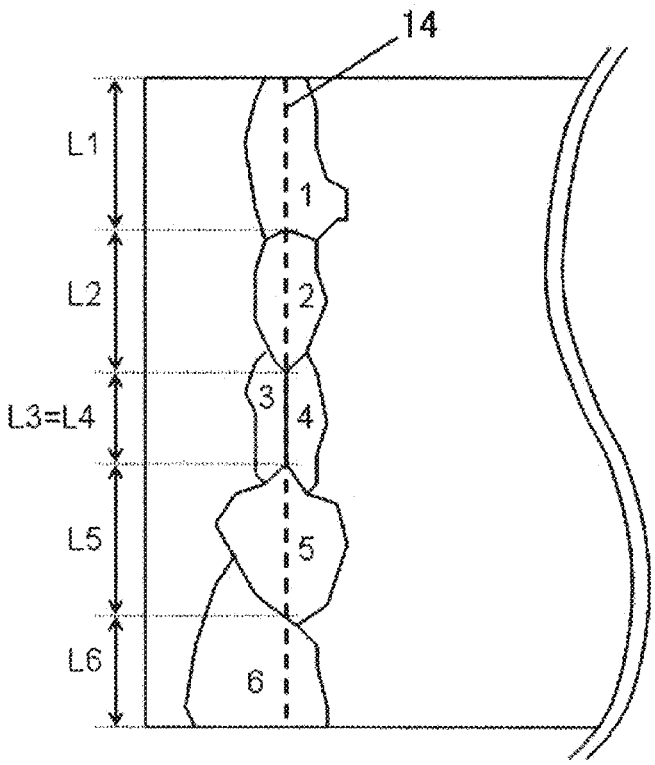
FIG. 18 is an explanatory drawing showing crystal grains generated around a linearly altered portion on the surface of the base metal iron portion of the steel sheet.

In the present embodiment, as shown in FIG. 18, for crystal grains generated in the base metal iron portion in the vicinity of the linearly altered portion 14 formed to be substantially parallel with the rolling direction of the grain oriented electrical steel sheet 10, an average value R of the deviation angle θa is defined by the following Formula (1):

[Math. 1]

$$R = \frac{\sum_i w_i \cdot L_i \cdot \theta a_i}{\sum_i w_i \cdot L_i} \quad (1)$$

where i denotes a number of the crystal grains; $L_i$ denotes a distance where the linearly altered portion 14 overlaps or be in contact with the i-th crystal grain; $\theta a_i$ denotes the above defined rotation angle θa for the i-th crystal grain. As indicated by the crystal grains other than the third and the fourth grains in FIG. 18, if a crystal grain is located across the linearly altered portion 14, $w_i$ is defined to be $w_i=1$. On the other hand, as indicated by the third and fourth crystal grains in FIG. 18, if the linearly altered portion 14 is located at the boundary between two crystal grains, $w_i$ is defined to be $w_i=0.5$.

As described later in Example, at the time of radiating a laser beam onto the surface of the steel sheet before the final annealing, if the inside of the base metal iron portion is so heat affected that the base metal iron portion melts and resolidifies, the crystal growth of the steel sheet is influenced during the final annealing, so that the deviation angle θa becomes greater, resulting in increase in percentage of abnormal crystal grains. Consequently, the magnetic property with respect to the rolling direction of the grain oriented electrical steel sheet tends to be deteriorated. To the contrary, at the time of radiating a laser beam during the final annealing, when only the $SiO_2$ coating film is heat affected, the crystal growth in the portion irradiated with the laser beam can be substantially equivalent to the crystal growth in the other portions which is not irradiated with the laser beam. Accordingly, the deviation angle θa becomes small, and thus it becomes more likely to be able to obtain normal crystal grains.

The producing method of the grain oriented electrical steel sheet of the present embodiment will be described hereinafter.

Figure 7:
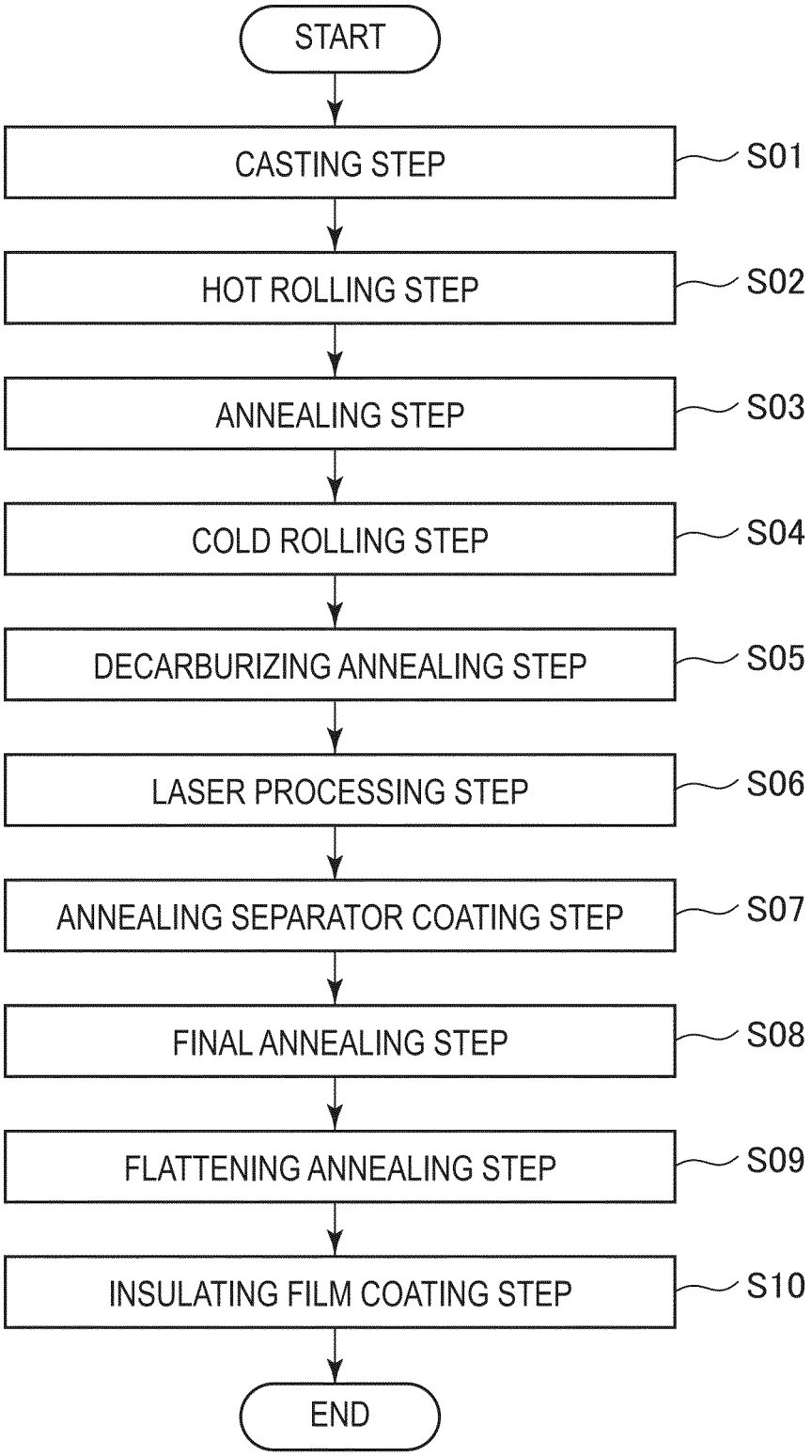
FIG. 7 is a flow chart showing a producing method of the grain oriented electrical steel sheet in one embodiment of the present invention.

The producing method of the grain oriented electrical steel sheet that is the present embodiment includes a casting step S01, a hot rolling step S02, an annealing step S03, a cold rolling step S04, a decarburizing annealing step S05, a laser processing step S06, an annealing separator coating step S07, a final annealing step S08, a flattening annealing step S09, and an insulating film coating step S10, as shown in a flow chart of FIG. 7.

In the casting step S01, melted steel prepared to include the above composition is supplied to a continuous casting machine so as to continuously produce ingots.

In the hot rolling step S02, each of the obtained ingots is heated at a prescribed temperature (e.g. 1150 to 1400° C.), and is hot-rolled. Through this step, a hot rolled material having a thickness of 1.8 to 3.5 mm is produced, for example.

In the annealing step S03, the hot rolled material is subjected to heat treatment under the following conditions: the annealing temperature of 750 to 1200° C., and the annealing time of 30 seconds to 10 minutes, for example.

In the cold rolling step S04, the surface of the hot rolled material after the annealing step S03 is pickled, and is then cold-rolled. Through this step, the steel sheet 11 having a thickness of 0.15 to 0.35 mm is produced, for example.

Figure 8:
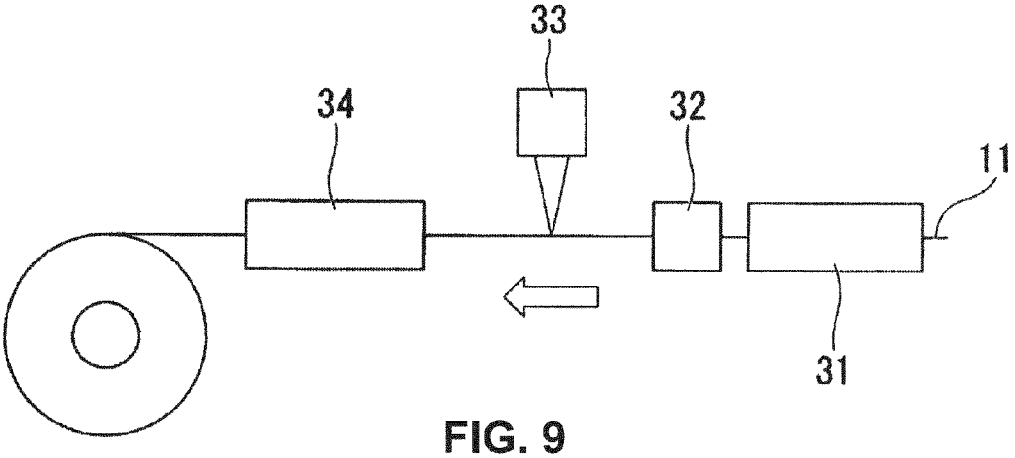
FIG. 8 is a schematic diagram explaining equipment that carries out a decarburizing annealing step, a laser processing step, and an annealing separator coating step.

In the decarburizing annealing step S05, the steel sheet 11 is subjected to heat treatment under the following conditions: the annealing temperature of 700 to 900° C. and, the annealing time of 1 to 3 minutes, for example. In the present embodiment, as shown in FIG. 8, the heat treatment is carried out by conveying the steel sheet 11 through a decarburizing annealing furnace 31 while the steel sheet 11 is kept traveling.

Through this decarburizing annealing step S05, a silica ($SiO_2$)-based $SiO_2$ coating film 12*a* is formed on each surface of the steel sheet 11.

Figure 10:
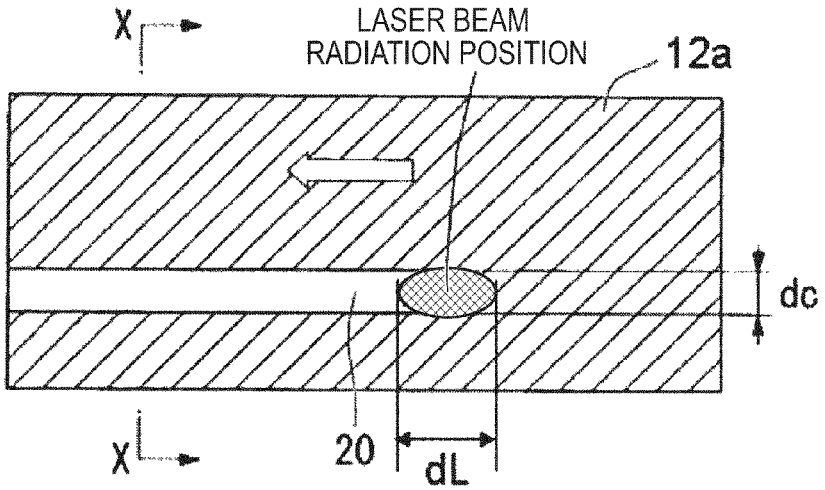
FIG. 10 is a schematic explanatory drawing showing a steel sheet on which the laser processing step is carried out.
Figure 11:
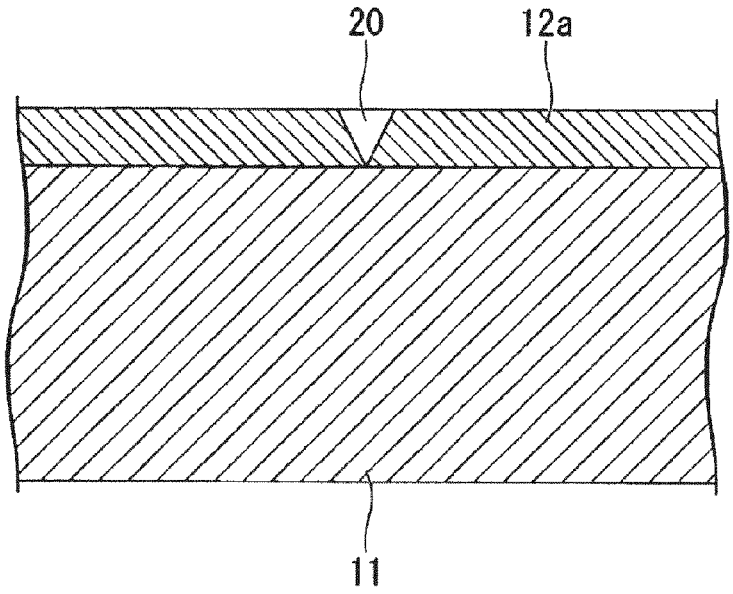
FIG. 11 is a cross sectional view taken in the direction of arrows X-X of FIG. 10.

In the laser processing step S06, as shown in FIG. 10 and FIG. 11, a laser beam is radiated in a direction parallel with the rolling direction onto the one of the side edge regions of the steel sheet 11 having the $SiO_2$ coating film 12*a* formed thereon under the laser radiation condition described in details later, thereby forming the laser processed portion 20 in the $SiO_2$ coating film 12*a* for the purpose of obtaining the linearly altered portion 14.

In the example of FIG. 11, the laser processed portion 20 is linearly generated in the rolling direction at the position corresponding to the aforementioned linearly altered portion 14, and is generated in a depth region from the outer layer of the $SiO_2$ coating film 12*a* toward the vicinity of the boundary between the $SiO_2$ coating film 12*a* and the steel sheet 11. In the example of FIG. 11, the laser processed portion 20 is a groove having a V-shaped cross section, but the shape of the cross section of the laser processed portion 20 is not limited to this example, and it may also be U-shaped, semicircular, or the like. The laser beam radiation condition will be described later; and depending on the laser beam radiation condition, there is such a case that the $SiO_2$ coating film 12*a* is only heat affected, so that physical change in shape, such as change in cross sectional shape, is hardly confirmed in the $SiO_2$ coating film 12*a*.

As shown in FIG. 8, the laser processing step S06 is carried out with a laser processing unit 33 positioned after the decarburizing annealing furnace 31. A cooling unit 32 for cooling the steel sheet 11 after the decarburizing annealing step S05 may be positioned between the decarburizing annealing furnace 31 and the laser processing unit 33. A temperature T of the steel sheet 11 to be subjected to the laser processing step S06 may be set within a range of 0° C.<T≤300° C. with this cooling unit 32, for example.

Figure 9:
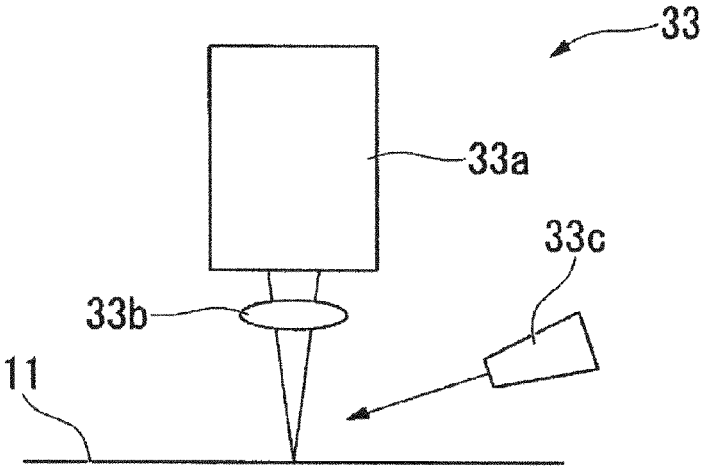
FIG. 9 is a schematic explanatory drawing showing a laser processing unit that carries out the laser processing step.

As shown in FIG. 9, the laser processing unit 33 includes a laser oscillator 33*a*, a condensing lens 33*b* for condensing a laser beam emitted from the laser oscillator 33*a*, and a gas nozzle 33*c* for injecting assist gas to the vicinity of a point irradiated with the laser beam. The type of the assist gas is not limited to a specific one, and air or nitrogen may be used for this gas, for example. The light source and the type of the laser beam are not limited to specific ones.

In the laser processing step S06, the laser beam radiation condition is appropriately adjusted such that no heat affected layer due to the laser beam radiation is generated in the base metal iron portion of the steel sheet 11 located inward of the portion of the $SiO_2$ coating film 12*a* irradiated with the laser beam (laser processed portion 20). For example, the laser beam radiation condition, such as the laser beam intensity (laser power P), is adjusted such that no prominent heat affected zone, such as a melted portion due to the laser beam radiation, is generated in the vicinity of the surface of the base metal iron portion in the steel sheet 11, and the surface of the base metal iron portion at a portion irradiated with the laser beam becomes as flat as the surface of the other portions of the base metal iron portion.

Let us consider a case where the following laser beam radiation conditions are given: the light source and the type of a certain laser, the laser beam diameter dc (mm) in the width direction of the steel sheet 11, the laser beam diameter dL (mm) in the traveling direction (longitudinal direction) of the steel sheet 11, the traveling speed VL (mm/sec) of the steel sheet 11, the sheet thickness t (mm) of the steel sheet, flow rate Gf (L/min) of the assist gas, and the like. In this case, when the laser power P (W) is gradually increased from zero while the above conditions are all fixed, the threshold value of the laser power P that generates melting on the surface of the base metal iron portion of the steel sheet 11 is set as P0 (W). Under such a condition, in the laser processing step S06, it is desirable that the laser power P is set to satisfy $0.3\times P0 \leq P < P0$, and the laser beam is radiated onto the $SiO_2$ coating film 12*a* of the steel sheet 11. Through this configuration, it is possible to appropriately generate the laser processed portion 20 through the laser beam radiation only in the $SiO_2$ coating film 12*a* without generating any melted portion in the base metal iron portion right below the irradiated position.

In the annealing separator coating step S07, the $SiO_2$ coating film 12*a* is coated with a magnesia (MgO)-based annealing separator, and the magnesia (MgO)-based annealing separator is dried by heating. In the present embodiment, as shown in FIG. 8, the annealing separator coating unit 34 is positioned after the laser processing unit 33, and the surface of the steel sheet 11 that has been subjected to the laser processing step S06 is continuously coated with the annealing separator.

The steel sheet 11 that has passed through the annealing separator coating unit 34 is wound up in a coil shape to be the coil 5. The outermost peripheral end of this coil 5 is to be a rear end of the steel sheet 11 that passes through the decarburizing annealing furnace 31, the laser processing unit 33, and the annealing separator coating unit 34. Hence, in the present embodiment, in the laser processing step S06, it is configured to generate the laser processed portion 20 in a region on the longitudinal rear end of the steel sheet 11.

Figure 12:
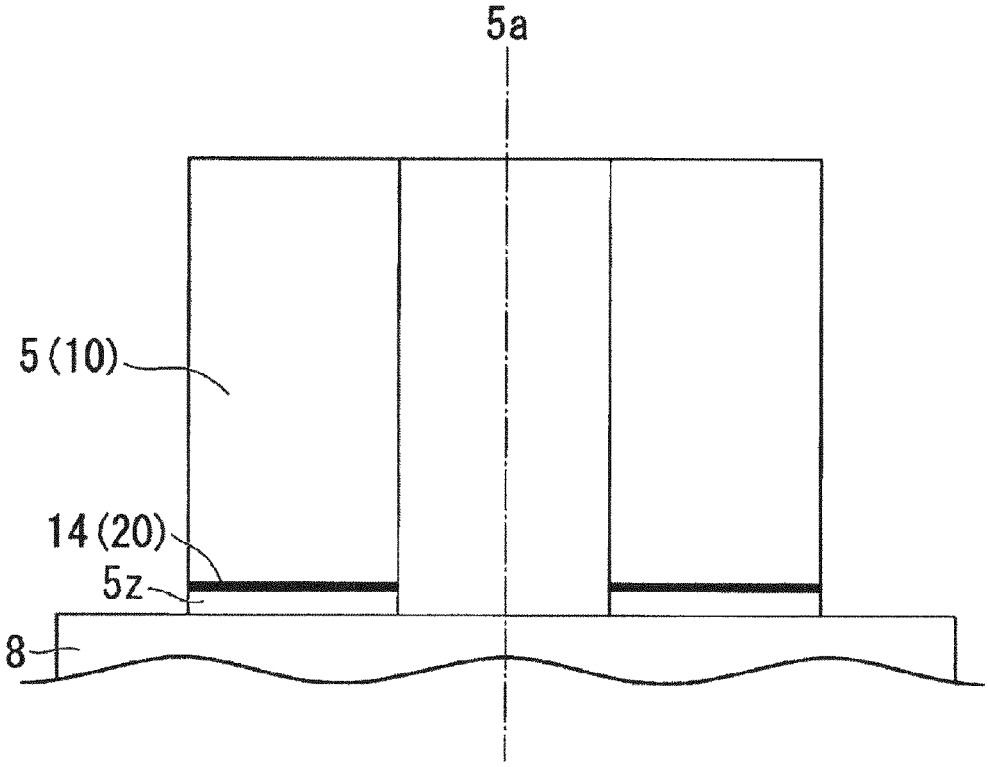
FIG. 12 is an explanatory drawing showing the grain oriented electrical steel sheet in one embodiment of the present invention, which is wound up into a coil shape.

As shown in FIG. 12, in the final annealing step S08, the coil 5 formed by winding up the steel sheet 11 which is coated with the annealing separator is placed on the coil receiver 8 with the coil axis 5*a* positioned in the vertical direction, and is placed in a batch-type final annealing furnace so as to apply heat treatment to the coil 5. The heat treatment condition of the final annealing step S08 is the annealing temperature of 1100 to 1300° C., and the annealing time of 20 to 24 hours, for example.

At this time, as shown in FIG. 12, the coil 5 (steel sheet 11) is placed on the coil receiver 8 in such a manner that the one of the side edges portion of the coil 5 (lower edge of the coil 5) where the laser processed portion 20 is generated comes into contact with the coil receiver 8.

During the final annealing step S08, the silica-based $SiO_2$ coating film 12*a* and the magnesia-based annealing separator react with each other so as to form the glass coating film 12 of forsterite ($Mg_2SiO_4$) on each surface of the steel sheet 11.

In the present embodiment, the laser processed portion 20 is generated in the depth region from the outer layer of the $SiO_2$ coating film 12*a* toward the vicinity of the boundary between the $SiO_2$ coating film 12*a* and the steel sheet 11. This region where the laser processed portion 20 is generated is to be the linearly altered portion 14 of the glass coating film 12 in the final annealing step S08. As aforementioned, in this linearly altered portion 14, the characteristic X-ray intensity of Mg obtained through the EPMA analysis tends to be smaller than that in the other portions of the glass coating film 12.

Accordingly, the linearly altered portion 14 generated in the glass coating film 12 can be identified as the linear Mg reduced portion where the characteristic X-ray intensity of Mg is reduced compared with that in the other portions of the glass coating film 12 (Ir<1.0). Mg is a representative element in the glass coating film 12, so that it is estimated that the thickness of the glass coating film itself is reduced in the linear Mg reduced portion. Hence, the linear Mg reduced portion has a smaller mechanical strength than that in the other portions, and becomes easy to be locally deformed, and thus it is possible to suppress propagation of the lateral strain in the final annealing step S08. As aforementioned, according to the EPMA analysis of the glass coating film 12, the characteristic X-ray intensity of Mg is easily reduced in the linearly altered portion 14, and the characteristic X-ray intensity of Fe is easily increased as compared with the other portions of the glass coating film 12. It can be considered that not only reduction in the thickness of the glass coating film 12 but also change in the percentage of elements, such as Mg and Fe (composition in a limited sense), contained in the glass coating film 12 contribute to reduction in the mechanical strength of the linearly altered portion 14. The change in the composition in the limited sense also appears as the change in the characteristic X-ray intensity through the EPMA analysis. The change in the thickness of the glass coating film 12 also causes change in amount of elements, such as Mg and Fe, contained in the glass coating film 12 having this thickness, and thus the characteristic X-ray intensity through the EPMA analysis is changed.

Accordingly, in the present invention, the "change in the thickness of the glass coating film" and the "change in the percentage of elements (composition in a limited sense) contained in the glass coating film", which appear as the change in the characteristic X-ray intensity through the EPMA analysis, are both considered as the "change in composition (composition in a broader sense) of the glass coating film". In the present invention, the "composition" represented in the "linearly altered portion having a composition different from that in the other portions of the glass coating film" denotes the above composition in the broad sense, and the "linearly altered portion" denotes a portion having the above composition in the limited sense or a thickness different from that in the other portions of the glass coating film.

In the flattening annealing step S09, the steel sheet 11 wound in a coil shape is unwound, stretched in a sheet state by applying tension at an annealing temperature of approximately 800° C., and conveyed so as to release the winding deformation of the coil, thereby flattening the steel sheet 11. At the same time as the flattening annealing step S09, in the insulating film coating step S10, the glass coating film 12 formed on the both surfaces of the steel sheet 11 is coated with an insulator material, and baking is performed so as to form the insulating coating film 13 thereon.

In this manner, the glass coating film 12 and the insulating coating film 13 are formed on each surface of the steel sheet 11, thereby producing the grain oriented electrical steel sheet 10 of the present embodiment.

Thereafter, the laser beam may be converged and radiated onto one surface of the steel sheet 10 to apply linear strains that are substantially vertical to the rolling direction and periodical in the rolling direction for the sake of magnetic domain control.

In the above producing method of the grain oriented electrical steel sheet 10, as described above, in the laser processing step S06, the laser processed portion 20 is generated in the region at the one of the side edge regions of the steel sheet 11 where the $SiO_2$ coating film 12*a* is formed. In the final annealing step S08 subsequent to the annealing separator coating step S07, the glass coating film 12 is formed from the $SiO_2$ coating film 12*a* and the annealing separator, and the linearly altered portion 14 is also generated in the region where the laser processed portion 20 is generated.

Figure 13:
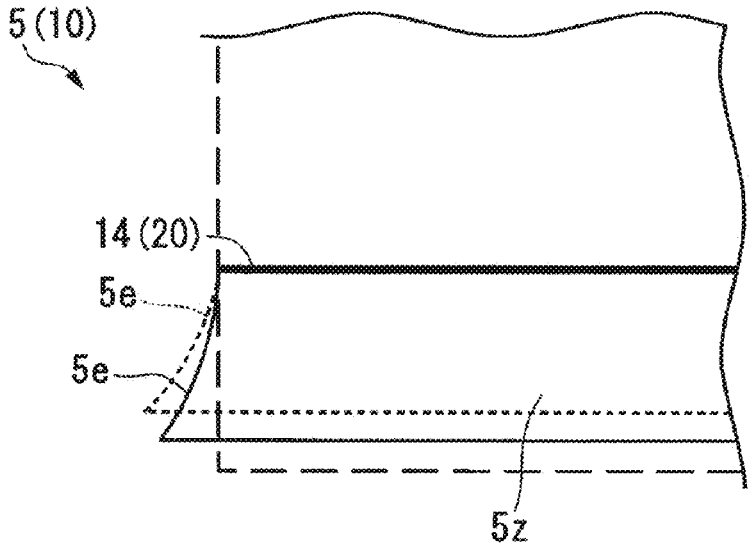
FIG. 13 is a schematic diagram showing a growing step of the lateral strain in the grain oriented electrical steel sheet in one embodiment of the present invention.

Here, in the final annealing step S08, as shown in FIG. 13, the linearly altered portion 14 is generated in the rolling direction of the coil 5 at a position on the coil 5 at a prescribed distance from the contact position between the coil 5 and the coil receiver 8 (i.e., in the one side edge portion of the coil 5). In this linearly altered portion 14, as described above, the composition in the limited sense, such as the composition ratio of Mg and Fe, and the thickness are different from those in the other portions of the glass coating film, so that it is considered that the mechanical strength thereof is also different from that in the other portions.

In the final annealing step S08, when the load is applied to the coil 5 by the weight thereof or the like, the laser processed portion 20 generated in the $SiO_2$ coating film 12*a* in the laser processing step S06 is preferentially deformed.

In the final annealing step S08, as shown in FIG. 13, the lateral strained portion 5*e* propagates from the contact portion between the coil 5 and the coil receiver 8 (one of the side edges of the coil 5) toward the other side of the side edges of the coil 5, but the above linearly altered portion 14 suppresses this propagation of the lateral strained portion 5*e*. Accordingly, the width of the lateral strained portion 5*e* becomes decreased, so that the trimming width can be reduced even in the case of removing this lateral strained portion 5*e*, which enhances the production yield of the grain oriented electrical steel sheet 10.

It is unnecessary to trim the lateral strained portion 5*e* if the produced grain oriented electrical steel sheet 10 including this lateral strained portion 5*e* satisfies quality required by a customer because the width and warp of the lateral strained portion 5*e* can be sufficiently reduced. In this case, it is possible to further enhance the production yield of the grain oriented electrical steel sheet 10. Because the base metal iron portion of the steel sheet 10 located inward of the portion of the glass coating film 12 where the linearly altered portion 14 is generated is hardly heat affected by the laser beam radiation, almost no abnormal crystal grains are generated, and the magnetic property is not deteriorated in the base metal iron portion at this position. Accordingly, even in the case of carrying out no trimming of the lateral strained portion 5*e*, it is possible to use the grain oriented electrical steel sheet 10 as it is as a product having an excellent magnetic property; therefore it is possible to enhance the quality as well as the product yield of the grain oriented electrical steel sheet 10.

In the present embodiment, the laser processed portion 20 is generated in the depth region from the outer layer of the $SiO_2$ coating film 12*a* toward the vicinity of the boundary between the $SiO_2$ coating film 12*a* and the steel sheet 11. Note that, as aforementioned, the radiation condition such as the intensity of the laser beam is adjusted such that inside the steel sheet 11, no significant heat affected layer resulted from melting due to the laser beam radiation is generated in the vicinity of the surface of the base metal iron portion, and flatness nearly equal to the surface of the base metal iron portion in the other portions is obtained. Consequently, as described later in detail, in the portion (base metal iron portion) located inward of the linearly altered portion 14 in the steel sheet 11, the average value R of the deviation angle θa of the direction of the axis of easy magnetization of the crystal grains of the steel sheet 11 deviating from the rolling direction can be reduced to be 20° or less.

Accordingly, the crystal orientation in the base metal iron portion located inward of the linearly altered portion 14 has more preferable and stable orientation than that in the prior art even if the width of the lateral strained portion 5*e* is so small that this lateral strained portion 5*e* is unnecessary to be removed; thus it is possible to use this steel sheet as the grain oriented electrical steel sheet 10 depending on the usage thereof.

Moreover, it is possible to reduce the power P of the laser beam to a low level in the laser processing step S06, thereby eliminating necessity for a large-scale and high-power laser apparatus, and this can attain efficient production of the grain oriented electrical steel sheet 10.

In the grain oriented electrical steel sheet 10 as one embodiment of the present invention, the distance WL from the one of the side edges of the steel sheet 11 to the center with respect to the width direction of the linearly altered portion 14 is set within 5 mm≤WL≤35 mm, and the width d of the linearly altered portion 14 is set within 0.3 mm≤d≤5.0 mm, and thus propagation of the lateral strained portion 5*e* can securely be suppressed by the linearly altered portion 14.

Starting from the outermost peripheral portion of the coil 5, the length Lz in the rolling direction of the linearly altered portion 14 (laser processed portion 20) is set as 20% or more of the total length Lc of the coil 5; therefore, it is possible to securely suppress propagation of the lateral strain even in the outer peripheral portion of the coil 5 where the lateral strain is likely to be generated.

Further, in one embodiment of the present invention, the linearly altered portion 14 includes the linear Mg reduced portion 14*a*. This linear Mg reduced portion 14*a* is a region of the glass coating film 12 where the Mg reduction ratio Ir (Ir=Ia/Ip) is within the range of 0.3≤Ir≤1.0. This linearly altered portion 14 (linear Mg reduced portion 14*a*) is a portion of the glass coating film 12 where the thickness is smaller than that in the other portions of the glass coating film 12, or where the composition of Mg, Fe, or the like (the composition in the limited sense) is altered unlike in the other portions of the glass coating film 12.

In one embodiment of the present invention, in the laser processing step prior to coating with the separator used for the final annealing, the laser beam with relatively low intensity is radiated such that no significant heat affected zone such as a melted portion is generated in the $SiO_2$ coating film 12*a* and in the vicinity of the surface of the base metal iron portion located inward of the $SiO_2$ coating film 12*a*, and the linearly altered portion 14 is generated from the above laser processed portion 20 in the final annealing step. Although a specific mechanism for this is not apparent, it can be considered that the linearly altered portion 14 (linear Mg reduced portion 14*a*) has smaller mechanical strength than the other portions, and thus this portion is more easily deformed. There also is such a possibility that residual strain introduced in the $SiO_2$ coating film 12*a* by the laser beam radiation may provide some influence. Consequently, it is estimated that, in the final annealing step, the local deformation in the linearly altered portion 14 (linear Mg reduced portion 14*a*) suppresses propagation of the lateral strained portion 5*e*.

The grain oriented electrical steel sheet 10 and the producing method of the grain oriented electrical steel sheet 10 have been described above as one embodiment of the present invention, but the present invention is not limited thereto, and various modifications can be appropriately made without departing from the technical ideas of the invention.

For example, the composition of the steel sheet 11 is not limited to the one specified by the present embodiment, and the steel sheet having a different composition may be used. It has been described that the decarburizing annealing step S05, the laser processing step S06, and the annealing separator coating step S07 are carried out by using the equipment shown in FIG. 8 and FIG. 9, but the present invention is not limited to this, and these steps may be carried out by using other equipment having different structures. The laser processing step S06 may be performed at any time between the decarburizing annealing step S05 and the final annealing step S08, and may be performed after the annealing separator coating step S07 and before the final annealing step S08, for example.

Figure 17:
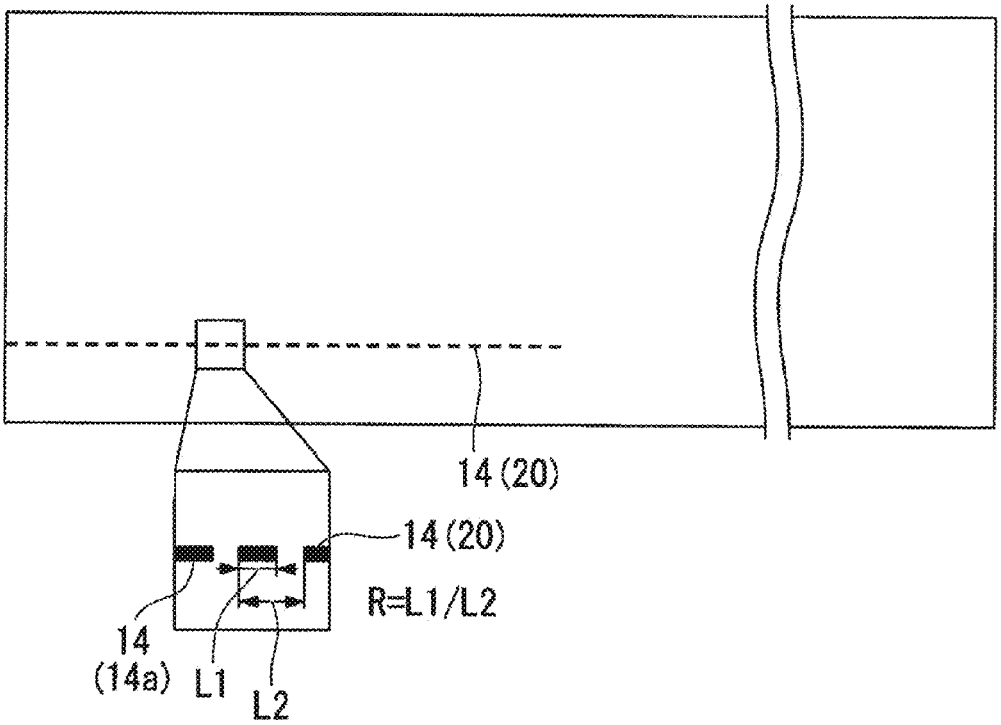
FIG. 17 is an explanatory drawing showing the grain oriented electrical steel sheet in another embodiment of the preset invention.

Further, as shown in FIG. 5, the linearly altered portion 14 has been described by using an example of generating the linearly altered portion 14 in a continuous line in a direction parallel with the rolling direction, but the present invention is not limited to this. For example, as shown in FIG. 17, the linearly altered portion 14 (laser processed portion 20) in a discontinuous broken line may periodically be generated in the rolling direction. This case has an effect of reducing average power of the laser beam. In the case of generating the periodical linearly altered portion 14, a rate r for the laser processed portion 20 per period is not limited to a specific one as far as the lateral strain reduction effect is attained, and it is preferable to set this rate as r>50%, for example.

The laser beam may be radiated onto both surfaces of the steel sheet 10 so as to generate the linearly altered portion 14 (laser processed portion 20) on both the surfaces of the grain oriented electrical steel sheet 10.

EXAMPLE

Description will be provided on a validation test that has been carried out for verifying the effects of the present invention.

First, slabs each having the following composition were casted: 3.0 mass % of Si, 0.05 mass % of C, 0.1 mass % of Mn, 0.02 mass % of acid-soluble Al, 0.01 mass % of N, 0.01 mass % of S, 0.02 mass % of P, and balance being Fe and inevitable impurities (casting step).

Each of these slabs was subjected to hot rolling at a temperature of 1280° C. so as to produce a hot-rolled material having a thickness of 2.3 mm (hot rolling step).

Then, the hot-rolled material was subjected to heat treatment under a condition of 1000° C.×1 minute (annealing step). The rolled material after the annealing step was subjected to pickling treatment after the heat treatment, and was then subjected to cold rolling so as to produce a cold-rolled material having a thickness of 0.23 mm (cold rolling step).

Decarburizing annealing was carried out on the cold-rolled material under a condition of 800° C.×2 minutes (decarburizing annealing step). Through this decarburizing annealing, the $SiO_2$ coating film 12*a* was formed on each surface of the steel sheet 11, which was the cold-rolled material.

A laser beam was radiated through the laser processing unit onto a surface of the steel sheet 11 on which the $SiO_2$ coating film 12*a* was formed so as to generate the laser processed portion 20 (laser processing step).

The laser processed portion 20 was generated in the $SiO_2$ coating film 12*a* in the steel sheet 11 and each surface thereof was coated with the magnesia-based annealing separator (annealing separator coating step).

The steel sheet 11 which had been coated with the annealing separator was wound up in a coil shape, and the steel sheet 11 in this state was placed in a batch-type final annealing furnace so as to finally anneal this steel sheet 11 under a condition of 1200° C.×20 hours (final annealing step).

At this stage, various different conditions were used for generating the laser processed portion 20, and a relation between these conditions and a width Wg of the lateral strained portion 5*e* (hereinafter, referred to as a "lateral strain width Wg") after the final annealing was evaluated.

Moreover, the direction of the axis of easy magnetization of the crystal grains in the base metal iron portion located inward of the linearly altered portion 14 in the steel sheet 11 was measured using the X-ray diffraction so as to find an average value R of the deviation angle θa of this direction of the axis of easy magnetization relative to the rolling direction. In addition, iron loss of W17/50 was also evaluated through an SST (single sheet tester) test. Each test specimen for the SST measurement in a size of 100 mm in width-directional length of the steel sheet, and 500 mm in length in the rolling direction of the steel sheet was cut out from a 100 mm wide region along the edge of the steel sheet.

The Mg reduction ratio Ir was measured in the linearly altered portion 14 generated in a portion corresponding to the laser processed portion 20 of the glass coating film 12. In this quantitative analysis of Mg, using the steel sheet 10 having the insulating coating film 13, which was a product, the insulating coating film 13 on the outermost layer of the steel sheet 10 was removed with an NaOH aqueous solution, and the composition of the glass coating film 12 was then analyzed through the EPMA. The characteristic X-ray intensity Ia of Mg in the linearly altered portion 14 was defined by using an average value obtained by averaging the X-ray intensity values of the Mg reduced portion at plural positions in the width d. The above analysis may be carried out after the final annealing step but before the insulating coating film forming step, thereby omitting a preparation step of washing off the insulating coating film 13 of the steel sheet 10 with an alkali solution such as NaOH prior to the analysis.

A semiconductor laser was used as the laser unit. The laser processing was carried out and evaluated under the following conditions: the laser beam diameter dL in the traveling direction (longitudinal direction) of the steel sheet 11 was dL=12 (mm), the travelling speed VL of the steel sheet 11 was VL=400 (mm/sec), the sheet thickness t of the steel sheet 11 was t=0.23 (mm), the flow rate Gf of the assist gas was Gf=300 (L/min), the laser beam irradiated position WL in the width direction of the steel sheet 11 was WL=20 (mm), by using as parameters the laser power P (W) and the laser beam diameter dc (mm) in the width direction of the steel sheet 11. The length Lz in the rolling direction of the laser processed portion 20 starting from the outermost peripheral portion of the coil was set as Lz=3000 m (total length Lc of the coil was Lc=10000 m).

Table 1 shows the radiation conditions of the laser beam and data on the evaluation result. P0 in Table 1 denotes a threshold value of the laser power P (W) that generates melting on the surface of the base metal iron portion of the steel sheet 11 when the laser power P was gradually increased from zero while the above conditions (dL, VL, t, Gf, WL) and dc were fixed. The lateral strain width Wg shown in Table 1 was the maximum value through the total length of the coil.

In Table 1, Examples 1 to 6 satisfy $0° \leq R \leq 20°$, and $0.3 \leq Ir \leq 0.95$. Examples 7 and 8 satisfy $0° \leq R \leq 20°$, but do not satisfy $0.3 \leq Ir \leq 0.95$, and have $0.95 < Ir < 1.0$. To the contrary, Comparative Examples 1 to 3 do not satisfy $0° \leq R \leq 20°$, and have $R > 20°$.

TABLE 1

Laser Radiation Conditions and Evaluation Results

| No. | Laser Beam Diameter dc (mm) | Laser Power P (W) | P0 (W) | Mg Reduction Ratio Ir | Lateral Strain Width Wg (mm) | Average Value of Deviation Angle R (°) | Iron Loss W17/50 (W/kg) |
|---|---|---|---|---|---|---|---|
| Example 1 | 0.5 | 800 | 1420 | 0.95 | 40 | 5 | 0.86 |
| Example 2 | 0.5 | 1000 | 1420 | 0.90 | 32 | 6 | 0.83 |
| Example 3 | 0.5 | 1100 | 1420 | 0.80 | 29 | 6 | 0.87 |
| Example 4 | 0.5 | 1200 | 1420 | 0.70 | 21 | 7 | 0.84 |
| Example 5 | 0.5 | 1300 | 1420 | 0.50 | 17 | 10 | 0.86 |
| Example 6 | 0.5 | 1400 | 1420 | 0.30 | 16 | 20 | 0.89 |
| Example 7 | 0.5 | 450 | 1420 | 0.99 | 45 | 5 | 0.85 |
| Example 8 | 0.5 | 600 | 1420 | 0.97 | 44 | 5 | 0.84 |
| Comparative Example 1 | 1 | 1750 | 1700 | 0.24 | 17 | 25 | 0.90 |
| Comparative Example 2 | 1 | 2000 | 1700 | 0.05 | 17 | 52 | 0.94 |
| Comparative Example 3 | 1 | 1800 | 1700 | 0.15 | 16 | 43 | 0.92 |

Figure 16:
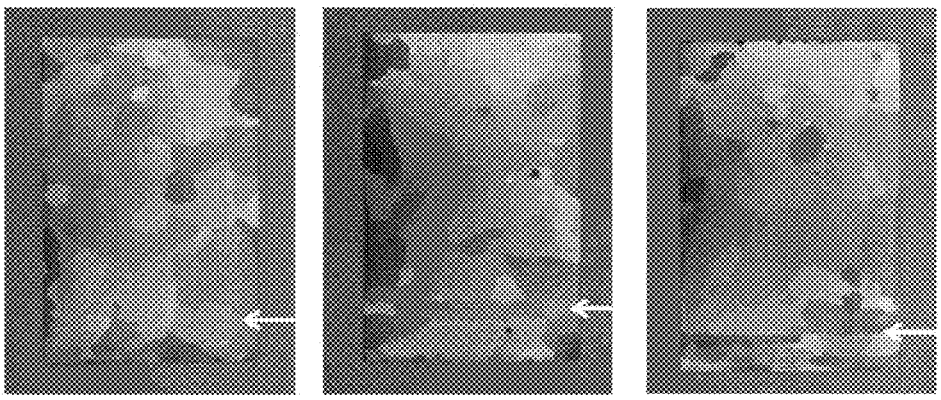
FIG. 16 shows photographs of structures showing states of crystal grains generated on the surface of the base metal iron portion of the steel sheet.
Figure 19:
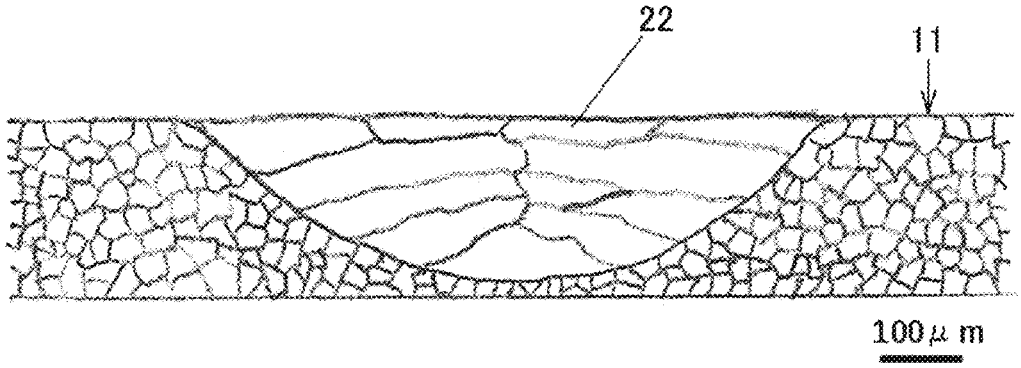
FIG. 19 is a schematic diagram showing a state of crystal grains in a cross section in a width direction of the steel sheet according to Comparative Examples.

The observation results of a microstructure in the base metal iron portion of each steel sheet 11 are shown in FIG. 16. As shown in FIG. 16, in the Comparative Examples 1 and 2, elongated crystal grains or grain boundaries extending in the rolling direction of each steel sheet 11 can be observed at a position (indicated by arrows in the drawing) corresponding to each laser processed portion 20 (linearly altered portion 14). Aforementioned abnormal crystal grains having great deviation angle θa of the direction of the axis of easy magnetization from the rolling direction are generated around such elongated crystal grains and grain boundaries. In the Comparative Examples 1 to 3, a microstructure in the cross section in the width direction of each steel sheet immediately after the laser beam radiation and before the final annealing was observed, and as schematically shown in FIG. 19, a microstructure of abnormal crystal grains (melted and resolidified portion 22) resulted from melted and resolidified base metal iron portion of the steel sheet 11 due to the laser beam radiation was observed. In the Comparative Examples 1 to 3, it is estimated that heat that had affected the inside of the base metal iron portion of the steel sheet 11 also affected crystal growth of the steel sheet 11, thus the abnormal crystal grains became likely to be generated.

To the contrary, in the Examples shown in FIG. 16 (corresponding to "Example 5" in Table 1), a portion of the base metal iron portion located at a position corresponding to the laser processed portion 20 (linearly altered portion 14) has a microstructure of crystal grains substantially equivalent to that in the other portions of the base metal iron portion. In a manner similar to that in the Comparative Examples, a microstructure in the cross section in the width direction of each steel sheet 11 after the laser beam radiation and before the final annealing was observed under the condition of the Examples; and no melted and resolidified portion 22 was observed even in the outermost layer of the base metal iron portion. In the Examples, it is estimated that the significant heat affected zone due to the laser beam radiation did not reach the base metal iron portion of the steel sheet 11, therefore, the crystal growth of the steel sheet 11 inward of the laser processed portion 20 progressed in the same manner as the crystal growth in the other portions of the steel sheet 11 in the final annealing step.

(Mg Reduction Ratio Ir)

Figure 20:
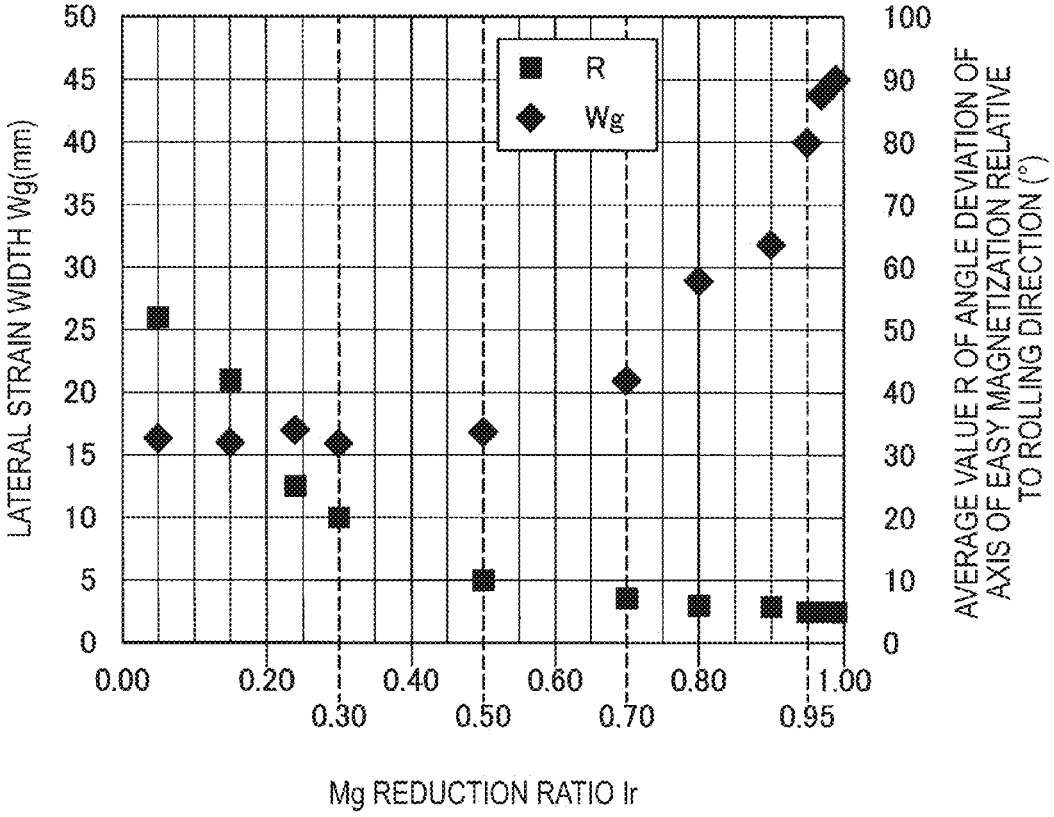
FIG. 20 is a graph showing a relation among an Mg reduction ratio, the lateral strain width, and an average value of a deviation angle of an axis of easy magnetization relative to the rolling direction of the steel sheet.

FIG. 20 shows a relation among the Mg reduction ratio Ir of the linearly altered portion 14 of the glass coating film 12 generated in a portion corresponding to the laser processed portion 20, the width Wg of the lateral strained portion, and the average deviation angle R of the axis of easy magnetization deviating from the rolling direction.

The EPMA analysis was carried out using the spatial resolution EPMA under the following conditions: the electron beam radiation intensity of 15 keV, the magnification of ×50, the visual field area of 2.5 mm×2.5 mm, the spatial resolution of 5 μm, and the X-ray analyzing crystals: TAP.

As shown in the Examples 1 to 6, if the Mg reduction ratio Ir is $0 \leq Ir \leq 0.95$, the lateral strain width Wg was reduced to be 40 mm or less. In the case of applying no laser processing to the steel sheet 11 (i.e., generating no linearly altered portion 14), Wg was 50 mm. As shown in the Examples 4 to 6, if $0 \leq Ir \leq 0.70$, the lateral strain width Wg becomes 21 mm or less, and the lateral strain width was further reduced. Accordingly, it is confirmed that in the linearly altered portion 14, it is preferable that the Mg reduction ratio Ir is 0.95 or less, and more preferably 0.70 or less. On the other hand, as shown in the Examples 7 and 8, in the case of $1.0 > Ir > 0.95$, Wg was 45 or less, and there was some more lateral strain reduction effect than in the case of applying no laser processing (Wg=50 mm), but Wg became greater than Wg in the Examples 1 to 6 by 10% or more, and it is confirmed that the lateral strain reduction effect was decreased.

FIG. 20 shows that the average value R of the deviation angle θa of the axis of easy magnetization relative to the rolling direction was quantified with respect to the crystal grains in the base metal iron portion located inward of the linearly altered portion 14, and also shows results of studying a correlation between the above Mg reduction ratio Ir and R. According to FIG. 20, it is understood that in the case of the Mg reduction ratio Ir of 0.3 or more, R can be reduced to be 20° or less. It is also understood that in the case of the Mg reduction ratio Ir of 0.5 or more, R can be reduced to be 10° or less.

With respect to data regarding the iron loss shown in Table 1, if R is 10° or less, the iron loss is equal to the reference value 0.85±0.02 (W/kg), and the variation in the iron loss is within a permissible error range, and thus it can be said that there is no deterioration of the iron loss. The reference value of the iron loss here represents the iron loss in the case of applying no laser processing to the steel sheet 11. The more the base metal iron portion of the steel sheet 11 is heat affected by the laser processing, the more the iron loss deviates from the reference value, which results in increase in the deterioration of the iron loss. If R is 20° or less, the margin of the deterioration is less than 0.05 (W/kg) relative to the reference value 0.85 (W/kg) although a tendency of deterioration of the iron loss is exhibited. On the other hand, if R is more than 20° as shown in the Comparative Examples 1 to 3, In particular, if R is 40° or more as shown in the Comparative Examples 2 and 3, deterioration of the iron loss becomes greater by 0.05 (W/kg) or more. Deterioration of the iron loss by 0.05 (W/kg) corresponds to deterioration in the grain oriented electrical steel sheet by one degree on the product grade basis. Hence, if R≤20°, such an effect can be attained that a side edge portion of the steel sheet 10 including the linearly altered portion 14 generated through the laser processing can be very likely to be shipped together with the other inner portions of the steel sheet 10 at the same product grade. To the contrary, if R>20°, the side edge portion including the linearly altered portion 14 of the steel sheet 10 has deterioration of the iron loss of 0.05 (W/kg) or more, which results in deterioration of the product grade at this edge portion by one degree or more. Consequently, this edge portion cannot be shipped together with the other inner portions of the steel sheet 10 at the same product grade, and thus in order to secure the product grade for the inner portions, this edge portion is required to be cut off, which deteriorates the yield of the steel sheet 10.

According to the results in FIG. 20, the smaller the Mg reduction ratio Ir becomes, the smaller the lateral strain width Wg can become, but the greater R becomes. To the contrary, the greater the Mg reduction ratio Ir becomes, the smaller R can become, but the greater the lateral strain width Wg becomes. Hence, it is understood that in order to achieve both goals of reduction of R in the base metal iron portion inward of the linearly altered portion 14 and reduction of the lateral strain width Wg at the same time, it is preferable to satisfy 0.3≤Ir≤1.0, and more preferable to satisfy 0.3≤Ir≤0.95, and even more preferable to satisfy 0.5≤Ir≤0.70.

Accordingly, in the case of applying no laser processing to the steel sheet 11, Wg becomes 50 mm, which attains no lateral strain reduction effect. To the contrary, in the case of applying the laser processing, it is possible to reduce the lateral strain without deteriorating the magnetic property of the base metal iron portion of the steel sheet 10. In particular, as shown in the Examples 1 to 6, through the laser processing under the appropriate laser radiation condition, it is possible to generate the linearly altered portion 14 that satisfies the condition of 0.3≤Ir≤0.95; therefore, the lateral strain can be significantly reduced (Wg≤40 mm) without deteriorating the magnetic property of the base metal iron portion (R≤20°). In the case of the laser processing with smaller power as shown in the Examples 7 and 8, the linearly altered portion 14 that satisfies 0.95<Ir<1.0 is generated, and thus the lateral strain reduction effect can be attained to some extent (40 mm<Wg<50 mm) without deteriorating the magnetic property of the base metal iron portion (R≤20°).

(Width d, Distance WL, and Length Lz in Rolling Direction of Laser Processed Portion 20 (Linearly Altered Portion 14))

Figure 15:
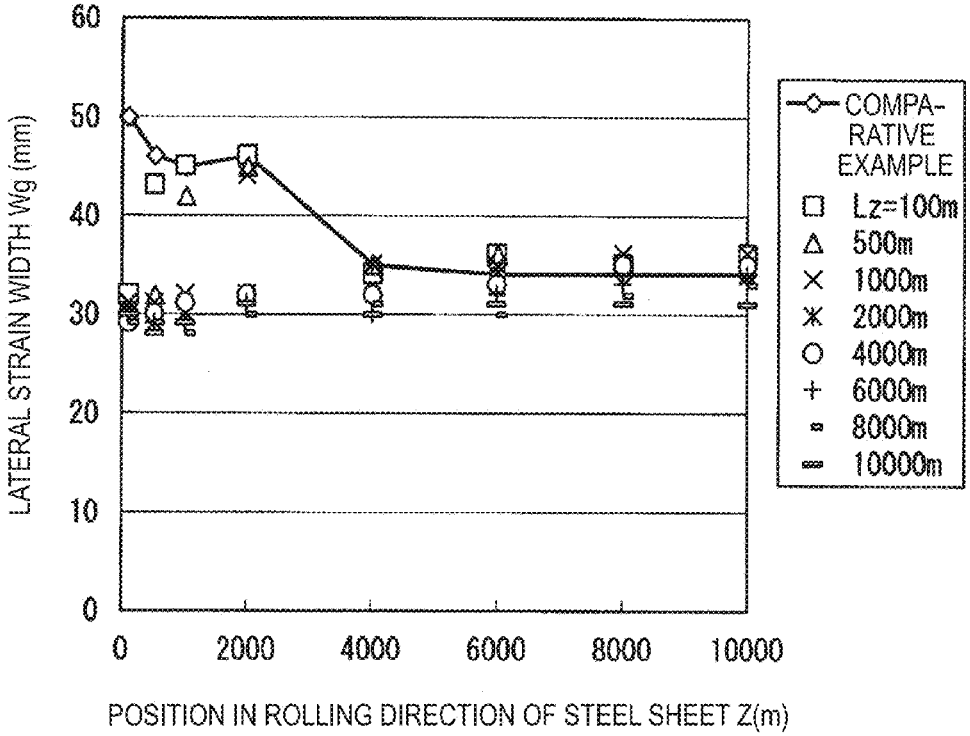
FIG. 15 is a graph showing a relation between a position in the rolling direction starting from an outermost peripheral portion of the finally annealed coil and the lateral strain width in the case of using various lengths in the rolling direction of the laser processed portion.

FIG. 15 shows a relation between the position Z in the rolling direction of the steel sheet 11 and the lateral strain width Wg using various different lengths Lz in the rolling direction of the laser processed portion 20 (linearly altered portion 14) starting from the outermost peripheral portion of the coil 5, in the case where the total steel sheet length Lc=10000 m. The origin of the position Z in the rolling direction of the steel sheet 11 is the outermost peripheral portion of the coil 5. The laser condition was in accordance with that in Example 2. The distance WL from the one of the side edges of the steel sheet 11 to the center with respect to the width direction of the laser processed portion 20 was set as WL=20 mm.

In the case of Lz of 500 m (5% of Lc), or Lz of 1000 m (10% of Lc), the lateral strain width Wg within the range of Z<4000 m was the same as that in the Comparative Examples having no laser processing. However, in the case of Lz of 2000 m or more, that is, 20% or more of the total steel sheet length Lc, the lateral strain width Wg is reduced to be approximately 30 mm across the total steel sheet length Lc. Hence, it can be said that it is preferable to generate the laser processed portion 20 (linearly altered portion 14) in a region of 20% or more from the outer peripheral portion of the coil where the lateral strain deformation is significant, thereby efficiently reducing the lateral strain in the outer peripheral portion of the coil 5 where significant lateral strain is generated.

Figure 14:
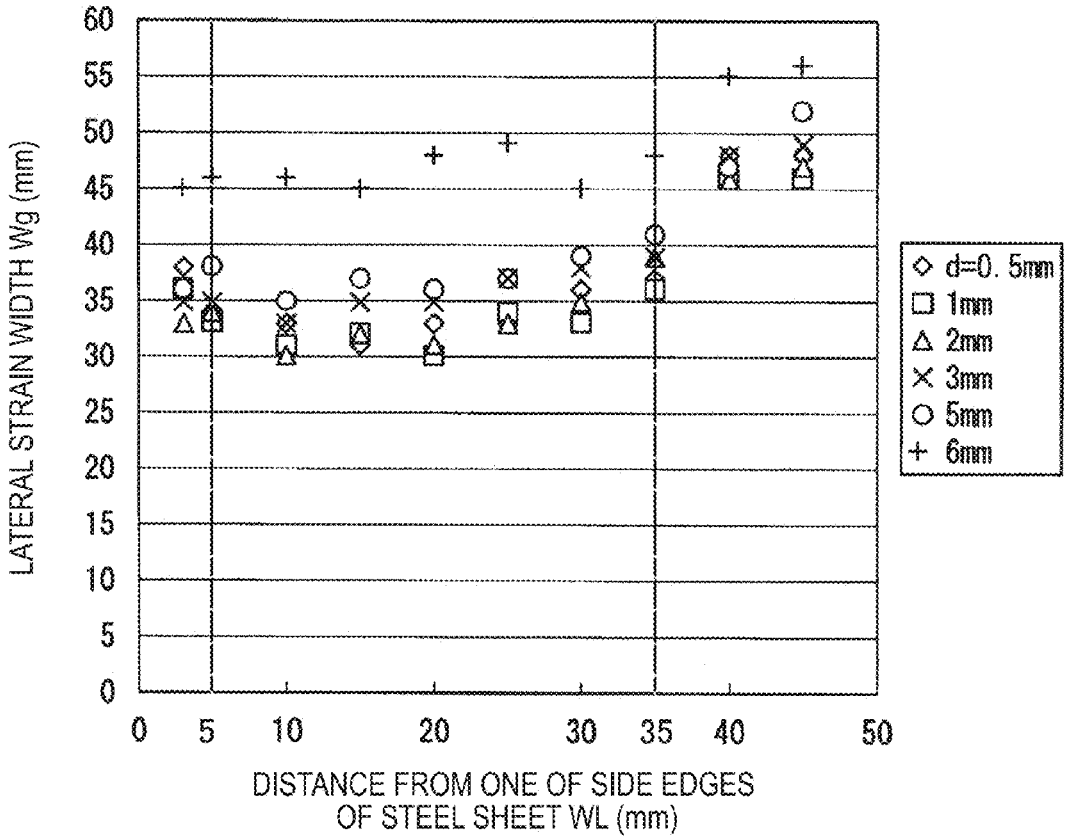
FIG. 14 is a graph showing a relation among a width of a laser processed portion, a distance from an edge portion of the steel sheet, and a lateral strain width.

In addition, FIG. 14 shows a relation between the distance WL from the one of the side edges of the steel sheet 11 to the center with respect to the width direction of the laser processed portion 20 (linearly altered portion 14), and the width Wg of the lateral strained portion. The length Lz in the rolling direction of the laser processed portion 20 (linearly altered portion 14) was set as Lz=3000 m (total length of the coil Lc=10000 m). The width d of the laser processed portion 20 (linearly altered portion 14) was set to have five levels: 0.5 mm, 1 mm, 2 mm, 3 mm, 5 mm, and 6 mm. The lateral strain width Wg shown in FIG. 14 is the maximum value relative to the total length of the coil.

As shown in FIG. 14, it is confirmed that in the case of the width d of the laser processed portion 20 (linearly altered portion 14) as great as 6 mm, the lateral strain width Wg becomes 45 mm or more, which exhibits a small effect of reducing the lateral strain width Wg. To the contrary, it is understood that in the case of the width d of 0.5 mm, 1 mm, 2 mm, 3 mm, and 5 mm, the lateral strain width Wg becomes approximately 40 mm or less, which exhibits that the lateral strain width Wg can appropriately be reduced. The laser processed portion 20 having a too thin width d hinders the portion of the laser processed portion 20 (linearly altered portion 14) from being deformed during the final annealing; thus it is preferable to set the width d as 0.3 mm or more.

Further, it was confirmed that in the case of the distance WL of 40 mm or more, even if the width d is 5 mm or less, the lateral strain width Wg was increased to be 45 mm or more, and the effect of reducing the lateral strain width Wg becomes decreased. To the contrary, if the distance WL is 35 mm or less, the lateral strain width Wg becomes approximately 40 mm or less under the condition of the width d of 5 mm or less, which exhibits that the lateral strain width Wg can appropriately be reduced. In particular, if the distance WL is within the range of 10 to 20 mm, it is possible to significantly reduce the lateral strain width Wg to be 35 mm or less under the condition of the width d of 3 mm or less. If the distance WL is less than 5.0 mm, Wg tends to be slightly increased, and thus it is preferable to set the distance WL as 5.0 mm or more.

Accordingly, it is preferable that the width d of the laser processed portion 20 (linearly altered portion 14) is set as 0.3 mm or more and 5.0 mm or less, and the position WL in the width direction is 5.0 mm or more and 35 mm or less. Through this configuration, it is possible to preferably reduce the lateral strain width Wg to be a permissible value (e.g. 40 mm) or less.

REFERENCE SIGNS LIST

5 Coil
5*e* Lateral strained portion
10 Grain oriented electrical steel sheet
11 Steel sheet
12 Glass coating film
12*a* $SiO_2$ coating film
14 Linearly altered portion
14*a* Linear Mg reduced portion
20 Laser processed portion
22 Melted and resolidified portion

The invention claimed is:

1. A grain oriented electrical steel sheet having a glass coating film formed on a surface of a base metal iron portion of the steel sheet, comprising: a linearly altered portion generated in the glass coating film at one of side edges of the steel sheet, in a continuous line or in a discontinuous broken line in a direction parallel with a rolling direction of the steel sheet, and having a composition different from a composition in other portions of the glass coating film, wherein the glass coating film comprises Mg, wherein an average value R of deviation angles θa of crystal grains positioned below the linearly altered portion in a base metal iron portion of the steel sheet is 0° or more and 20° or less, when the deviation angle θa is defined as a deviation angle of a direction of an axis of easy magnetization of each crystal grain relative to the rolling direction, wherein a characteristic X-ray intensity Ia of Mg in the linearly altered portion of the glass coating film is smaller than an average value Ip of the characteristic X-ray intensity of Mg in the other portions of the glass coating film, wherein the characteristic X-ray intensity Ia of Mg in the linearly altered portion and the average value Ip of the characteristic X-ray intensity of Mg in the other portions of the glass coating film are obtained through an EPMA analysis, and the linearly altered portion is identified in the glass coating film as an Mg reduced portion whose Mg reduction ratio Ir that is a ratio of the Ia relative to the Ip is 0.3 or more and 0.95 or less, and wherein the linearly altered portion is generated only in the glass coating film and not in the base metal iron portion of the steel sheet.

2. The grain oriented electrical steel sheet according to claim 1, wherein a laser beam is radiated in a direction parallel with the rolling direction onto a region at the one of the side edge regions of the steel sheet having an $SiO_2$ coating film formed on a surface thereof so as to generate a laser processed portion in a continuous line or in a discontinuous broken line in a depth region from an outer layer of the $SiO_2$ coating film toward a boundary between the $SiO_2$ coating film and the steel sheet, wherein the laser processed portion in the $SiO_2$ coating film is altered, and wherein the linearly altered portion is generated in the glass coating film.

3. The grain oriented electrical steel sheet according to claim 1, wherein a distance WL from the one of the side edges of the steel sheet to a center with respect to the width direction of the linearly altered portion is 5 mm or more and 35 mm or less, and wherein a width d of the linearly altered portion is 0.3 mm or more and 5.0 mm or less.

4. The grain oriented electrical steel sheet according to claim 1, wherein the linearly altered portion is generated in a region of 20% or more and 100% or less of a total length in the rolling direction of the steel sheet, and the region starts from one end in the rolling direction of the steel sheet corresponding to an outermost periphery of the steel sheet when the steel sheet is wound up in a coil shape in a final annealing step.

5. A method of producing the grain oriented electrical steel sheet having a glass coating film formed on a surface thereof of claim 1, the method comprising:

a laser processing step of radiating, onto one of side edge regions of a steel sheet having an $SiO_2$ coating film formed on a surface thereof, a laser beam in a direction parallel with a rolling direction of the steel sheet so as to generate a laser processed portion in a continuous line or in a discontinuous broken line;

an annealing separator coating step of coating each surface of the steel sheet with an annealing separator after the laser processing step; and a final annealing step of finally annealing the steel sheet which is coated with the annealing separator so as to form the glass coating film on each surface of the steel sheet, wherein the laser processed portion is generated in a depth region from an outer layer of the $SiO_2$ coating film toward a boundary between the $SiO_2$ coating film and the steel sheet, wherein, in the final annealing step, the steel sheet is wound up in a coil shape, the steel sheet in the coil shape is placed and finally annealed with the one of the side edges thereof where the laser processed portion is directed downward, the glass coating film is generated from the $SiO_2$ coating film and the annealing separator, and a linearly altered portion having a composition different from a composition in other portions of the glass coating film is formed in a portion corresponding to the laser processed portion, wherein an average value R of deviation angles θa of crystal grains positioned below the linearly altered portion in a base metal iron portion of the steel sheet is 0° or more and 20° or less, when the deviation angle θa is defined as a deviation angle of a direction of an axis of easy magnetization of each crystal grain relative to the rolling direction in the steel sheet after the final annealing step, wherein the characteristic X-ray intensity Ia of Mg in the linearly altered portion and the average value Ip of the characteristic X-ray intensity of Mg in the other portions of the glass coating film are obtained through an EPMA analysis, and the Ia is smaller than the Ip, and the linearly altered portion is identified in the glass coating film as an Mg reduced portion whose Mg reduction ratio Ir that is a ratio of the Ia relative to the Ip is 0.3 or more and 0.95 or less.

6. The method of producing a grain oriented electrical steel sheet, according to claim 5, wherein, in the laser processing step, the laser processed portion is generated in such a manner that a distance WL from the one of the side edges of the steel sheet to a center with respect to the width direction of the laser processed portion is 5 mm or more and 35 mm or less, and a width d of the laser processed portion is 0.3 mm or more and 5.0 mm or less.

7. The method of producing a grain oriented electrical steel sheet, according to claim 5, wherein, in the laser processing step, the laser processed portion is generated in a region of 20% or more and 100% or less of a total length in the rolling direction of the steel sheet, and the region starts from one end in the rolling direction of the steel sheet corresponding to an outermost periphery of the steel sheet when the steel sheet is wound up in a coil shape in the final annealing step.

8. The method of producing a grain oriented electrical steel sheet, according to claim 6, wherein, in the laser processing step, the laser processed portion is generated in a region of 20% or more and 100% or less of a total length in the rolling direction of the steel sheet, and the region starts from one end in the rolling direction of the steel sheet corresponding to an outermost periphery of the steel sheet when the steel sheet is wound up in a coil shape in the final annealing step.

* * * * *